US009443381B2

(12) United States Patent
Nicely et al.

(10) Patent No.: US 9,443,381 B2
(45) Date of Patent: Sep. 13, 2016

(54) CUSTOMIZATION OF GAMING EVENT RE-CREATION

(71) Applicant: IGT, Reno, NV (US)

(72) Inventors: Mark C. Nicely, Daly City, CA (US); Kari L. O'Driscoll, Pacifica, CA (US)

(73) Assignee: IGT, Reno, NV (US)

( * ) Notice: Subject to any disclaimer, the term of this patent is extended or adjusted under 35 U.S.C. 154(b) by 123 days.

(21) Appl. No.: 14/022,853

(22) Filed: Sep. 10, 2013

(65) Prior Publication Data

US 2015/0072782 A1 Mar. 12, 2015

(51) Int. Cl.
*A63F 9/24* (2006.01)
*G07F 17/32* (2006.01)

(52) U.S. Cl.
CPC ..... *G07F 17/3234* (2013.01)

(58) Field of Classification Search
CPC ..... G07F 17/3211; G07F 17/3223; G07F 17/3241; G07F 17/3225; G07F 17/3234; A63F 2300/634; G06Q 30/0255
See application file for complete search history.

(56) References Cited

U.S. PATENT DOCUMENTS

2005/0064926 A1* 3/2005 Walker et al. ..... 463/16

* cited by examiner

*Primary Examiner* — Steve Rowland
(74) *Attorney, Agent, or Firm* — Griffiths & Seaton PLLC

(57) ABSTRACT

For facilitating re-experience of an event of a gaming device with a player, data is gathered in a data processing device, in communication with, yet external to, the gaming device, the data processing device having been provided a sampling of data from the gaming device by a gaming system having supervisory hierarchical control over the gaming device. At least a portion of the sampled data is processed to generate a facsimile animation re-creation of the event to be provided to the player. The facsimile animation re-creation is editable through the data processing device by use of at least one predefined rule, an operator of the data processing device, and a player granted subsequent access to the data processing device.

18 Claims, 20 Drawing Sheets

CUSTOMIZATION OF GAMING EVENT RE-CREATION

CROSS-REFERENCE TO RELATED APPLICATIONS

This Application is related to co-pending U.S. Patent Applications bearing application Ser. Nos. 14/022,832, 14/022,844, 14/022,857 and 14/022,866, filed concurrently herewith and incorporated herein by reference.

BACKGROUND OF THE INVENTION

1. Copyright Notice

A portion of the disclosure of this patent document contains or may contain material, which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

2. Field of the Invention

The present invention relates in general to gaming devices and systems, and more particularly to mechanisms for facilitating re-creation of an event of a gaming machine at a subsequent time using input/output (I/O) overlays.

3. Description of the Related Art

Games of chance have been enjoyed by people for many years and have undergone increased and widespread popularity in recent times. As with most forms of entertainment, some players enjoy playing a single favorite game, while others prefer playing a wide variety of games. In response to the diverse range of player preferences, gaming establishments commonly offer many types of electronic games. Many electronic gaming machines (EGMs), such as slot machines and video poker machines, have been a cornerstone of the gaming industry for several years. The EGMs are computer based and contain multiple external interfaces for connecting with external devices and mobile devices.

SUMMARY OF THE DESCRIBED EMBODIMENTS

Gaming institutions have a continuing interest in encouraging greater participation by existing players, encouraging other persons to visit a gaming environment, and enhancing the overall experience offered to existing and new customers alike. One mechanism that may encourage greater participation and enhance overall experience is the ability for the player to re-experience and/or share their experiences in the gaming environment with friends and loved ones. Applicants have recognized that players may even attempt to record their experiences in gaming environments and later share them in social networking settings, for example. Use of cameras and video cameras in gaming settings however is generally prohibited due to regulatory, safety, privacy, security, and other concerns. Accordingly, a need exists for mechanisms to facilitate re-experience of positive events that a player may experience in a gaming environment but provided and facilitated to the player by the gaming establishment so as to alleviate those concerns. Additionally, a need exists to provide players the ability to control which events to capture and to control with whom such events are to be shared. Furthermore, in view of environmental limitations, a need exists for the ability of this mechanism to minimize resource consumption factors such as bandwidth, data processing resources, data storage resources and the like.

To address these aforementioned needs, various system, method, and computer program product embodiments are provided for facilitating re-experience of an event of a gaming device with a player.

In one embodiment, by way of example only, upon a triggering mechanism associated with the event, an input/output (I/O) mechanism is overlaid on the gaming device using a system device in communication with the gaming device. Through use of the I/O mechanism, input is received from the player and output is returned to the player. The I/O mechanism overlaying the gaming device is then removed. The I/O overlay provides functionality to facilitate the event re-experience without the necessity encumbering additional game-specific resources, such as game-specific coding.

In another embodiment, again by way of example only, at least one of an available plurality of data sampled by the gaming device by a gaming system having supervisory hierarchical control over the gaming device, is monitored. The data is compared against a predetermined threshold to determine whether the predetermined threshold is exceeded. If the threshold is exceeded, at least a portion of the sampled data is provided to a data processing device to be processed in re-creating the event at a subsequent time. The thresholding is customizable to specific gaming applications and situations so as to limit occasions in which events are recreated, for example, to assist in conserving system resources.

In still another embodiment, again by way of example only, data is sampled from the gaming device by a gaming system having supervisory hierarchical control over the gaming device, the data provided by the gaming system to a data processing device in communication with the gaming system, that is external to the gaming device. The sampled data is processed to create a facsimile animation recreation of the event at a subsequent time. Sampling and processing the data provides a mechanism to recreate the event short of video capture, for example, which consumes limited system resources.

In another embodiment, again by way of example only, data is gathered in a data processing device, in communication with, yet external to, the gaming device. The data processing device is provided a sampling of data from the gaming device by a gaming system having supervisory hierarchical control over the gaming device. At least a portion of the sampled data is processed to generate a facsimile animation re-creation of the event to be provided to the player. The facsimile animation re-creation is editable through the data processing device by use of at least one predefined rule, an operator of the data processing device, and a player granted subsequent access to the data processing device. Providing editing functionality using resources apart from the gaming floor enhances, for example, the gaming experience for customers while, again, conserving system gaming resources associated with the gaming floor.

In still yet another embodiment, again by way of example only, upon verification, access is granted to the player to a data processing device. The data processing device is in communication with, yet external to, the gaming device, and the data processing device has been provided a sampling of data from the gaming device through a gaming system, the sampling of data associated with the event to be re-experienced by the player. Responsive to an input received from at least one of the player and an operator, at least one of construction, presentation, and delivery of a facsimile animation re-creation of the event is customized. Further customization of the event re-creation process serves, for example, to further enhance the gaming experience for customers.

Other systems, methods, and computer program product embodiments are provided and supply related advantages.

The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
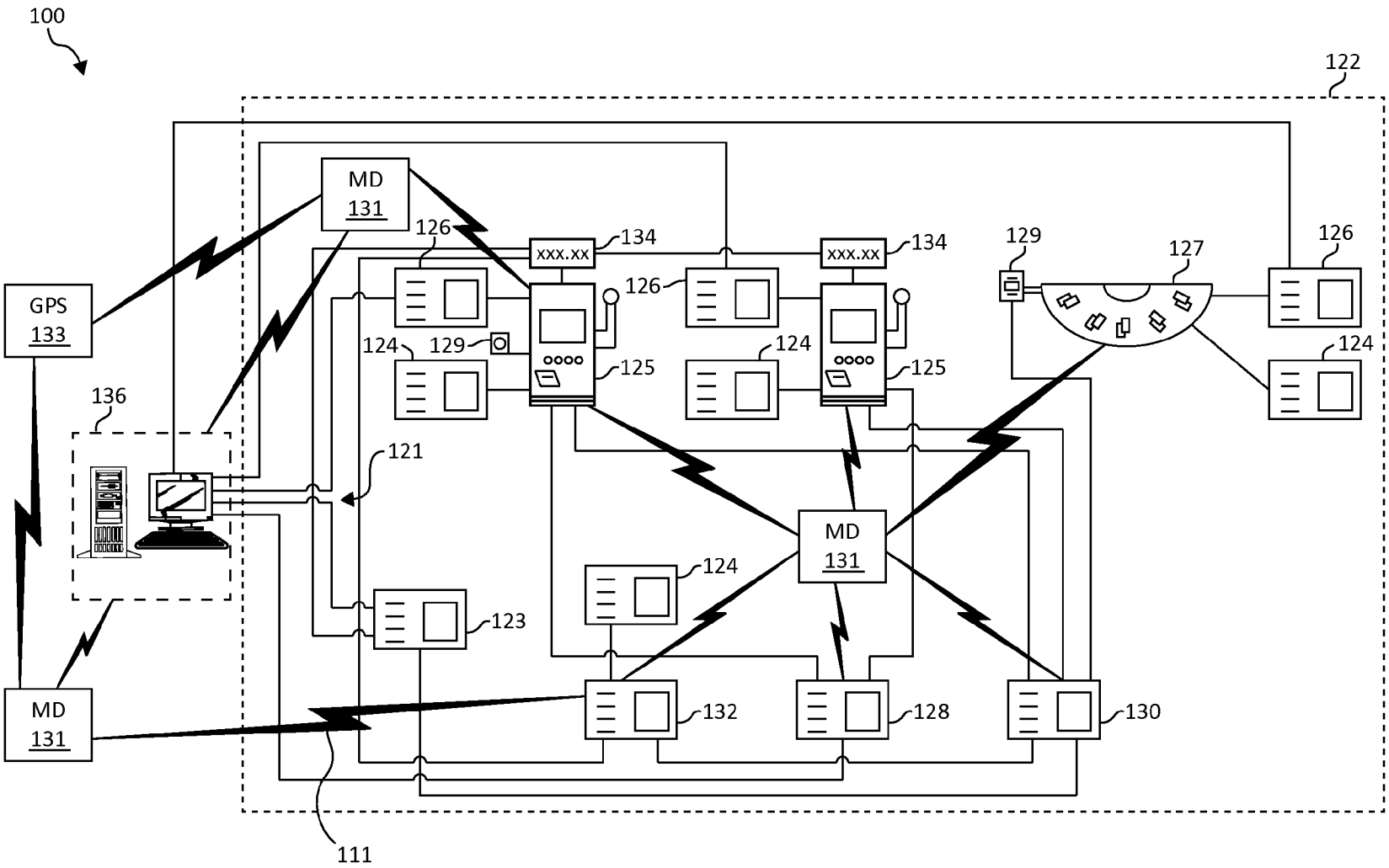
FIG. 1 is a block diagram illustrating a gaming system environment with a gaming terminal data repository (GTDR) connected via one or more network interface(s) to a gaming network which, for example, may include gaming devices (e.g., gaming terminals), in which aspects of the present invention may be realized.

In general, gaming machines require a player to place or make a wager to activate a primary or base game. The award may be based on the player obtaining a winning symbol or symbol combination and on the amount of the wager (e.g., the higher the wager, the higher the award). Symbols or symbol combinations that are less likely to occur usually provide higher awards. In such gaming machines, the amount of the wager made on the base game by the player may vary. For instance, a gaming machine may allow the player to wager a minimum number of credits, such as one credit (e.g., one penny, nickel, dime, quarter or dollar, or for virtual currency, one point, one coin, one credit, or one virtual buck) up to a maximum number of credits, such as five credits. The player may make this wager a single time or multiple times in a single play of a primary game. For instance, a slot game may have one or more pay lines and the slot game may allow the player to make a wager on each pay line in a single play of the primary game. Slot games with 1, 3, 5, 9, 15 and 25 lines may be provided. Thus, a gaming device, such as a slot game, may allow players to make wagers of substantially different amounts on each play of the primary or base game ranging, for example, from one credit up to 125 credits (e.g., five credits on each of 25 separate pay lines). This is also true for other wagering games, such as video draw poker, where players can wager one or more credits on each hand and where multiple hands can be played simultaneously. Different players play at substantially different wagering amounts or levels and at substantially different rates of play.

Secondary or bonus games may also be provided in the gaming machines. The secondary or bonus games may provide an additional award to the player. Secondary or bonus games may not require an additional wager by the player to be activated. Secondary or bonus games may be activated or triggered upon an occurrence of a designated triggering symbol or triggering symbol combination in the primary or base game. For instance, a bonus symbol occurring on the pay line on the third reel of a three-reel slot machine may trigger the secondary bonus game. When a secondary or bonus game is triggered, the gaming machines may indicate this to the player through one or more visual and/or audio output devices, such as the reels, lights, display units, speakers, video screens, etc. Part of the enjoyment and excitement of playing certain gaming machines is the occurrence of the secondary or bonus game (even before the player knows how much the bonus award will be). In other words, obtaining a bonus play experience is part of the enjoyment and excitement for players.

Progressive awards may also be provided in gaming machines. A progressive award may be an award amount that includes an initial amount funded by a casino and an additional amount funded through a portion of each wager made on the progressive gaming machine. For example, 1% to 5% of each qualifying wager placed on the primary game of the gaming machine associated with the progressive award may be allocated to the progressive award or progressive award fund. The progressive award grows in value as more players play the gaming machine, and thus, portions of these players' wagers are allocated to the progressive award. When a player obtains a winning symbol or symbol combination, which results in the progressive award, the accumulated progressive award is provided to the player. After the progressive award is provided to the player, the amount of the next progressive award may be reset to an initial value, a predetermined value, or randomly generated value, and a portion of each subsequent wager on a gaming machine associated with the progressive is allocated to the next progressive award as described above.

A progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such progressive awards are sometimes called local area progressive ("LAP") and wide area progressive ("WAP"), respectively. Progressive awards may increment through communication between a progressive controller and one or more gaming machines. The gaming machines associated with the progressive award transfer coin-in information to a progressive controller. From this information, the progressive controller calculates how much to increment the progressive award based on a set increment rate and then increments the progressive award accordingly. The gaming machines may provide the player a choice between different wager levels prior to the commencement of a primary game. The different wager levels enable the player to win different progressive awards. The gaming devices provide a progressive jackpot where the value of the jackpot may increase by a particular amount for every game played. Thus, when multiple gaming devices are linked together to form one large progressive jackpot, the jackpot grows more quickly because multiple players are contributing to the jackpot at the same time.

In one embodiment, there may be one or more various types of EGM machines, each having a variety of gaming themes, on any casino floor (and/or other gaming venue) using the above described gaming systems. The EGMs may uses the various gaming award systems, jackpots, progressive jackpots, and/or other type of gaming systems and awards. As mentioned above, users of the various gaming devices (e.g., an EGM) have a general interest in, and may expend resources trying to identify, which of these various and preferred EGMs are paying out the largest and most frequent awards and/or progressive jackpots. As such, a need exist for providing in real time, to a user, one or more of the user's favorite and/or preferred EGMs, and/or a list of EGM devices available and/or unavailable in the gaming venue, in order to play one or more of the favorite and/or preferred EGMs (e.g., the EGM labeled as "Wheel of fortune").

As mentioned previously, users of these gaming devices have a general interest in re-experiencing events such as wins, free spins, bonuses, and the like at a subsequent time. In addition, these users also have a general interest to share these personal experiences with friends, loved ones, associates, and others. The advent of social networking has helped to increase the desire of players to distribute the good experiences that they have had in gaming environments to acquaintances they share through these social networking channels. Notable outcomes that are shared by the player to acquaintances also boosts visibility to the gaming environment, while also providing incentives to the player to return to the gaming environment. Additionally, viewing positive experiences from the gaming environment will tend to reinforce the player's positive experience, and encourage others to visit the gaming environment.

Accordingly, gaming environments have a strong need to facilitate the delivery of the notable event to the player and the player's acquaintances. Concurrently, gaming environments share a need to reduce prohibited activities such as video recording and the like. Coupled with the need to facilitate delivery of this content is the need to do so as efficiently as possible. It is well known to those of ordinary skill in the art that the hardware and related resource requirements to record or otherwise capture, process, and deliver such content are intensive. Due to the large amount of resources necessary for capturing, processing and delivering such content, the costs for such implementation may also be prohibitively expensive. A need exists for a mechanism to effectuate the delivery of content reflective of the player's experiences that consumes the least amount of resources possible in the most-cost effective manner. Moreover, it would be beneficial for such a mechanism or mechanisms to be easily incorporated and used in conjunction with existing hardware, network and other existing infrastructure.

The illustrated embodiments of the present invention, following, serve to provide these mechanisms for delivering cost-effective, resource efficient content that conserves bandwidth, storage space, network, power, installation, and other limited resources, yet still provides satisfactory delivery of content that effectively re-creates the player's notable experiences in the gaming environment.

Moreover, the illustrated embodiments provide customization, editing, and delivery options (among others) that the player can take advantage of so as to make the most of the notable experience that the player wishes to re-experience.

Use of these illustrated mechanisms allows for the player to achieve as much utility as possible, involve as many people as the player wishes as possible, yet saving resources and allowing for a breadth of installation across large gaming environments without exorbitant cost.

In one of the illustrated embodiments, a triggering mechanism is implemented. This triggering mechanism allows for resource conservation, since data from only those events that have triggered the mechanism are preserved and/or processed. This trigger mechanism may be implemented on a resource-specific basis, tied to certain games or machines, tied to certain player behavior, customizable by operators or even by players alike, depending on the particular situation.

In conjunction with the trigger mechanism, an Input/Output (I/O) overlay is used to deliver messages, indications, and other content to the player in a standardized way using current gaming environment hardware and networking infrastructure. This I/O overlay can deliver information to the player, or collect information regarding the event to be subsequently re-created in what will be referred to throughout herein as a "facsimile event re-creation." The overlay may be delivered using current infrastructure such as service windows that are common in gaming machine environments. The player may then use the overlay to designate, for example, whether they wish to re-experience the event at a subsequent time and, moreover, whether they wish to share the event with others. The overlay mechanism may be easily placed and removed at appropriate times and settings throughout the gaming environment.

In addition to the triggering and overlay mechanisms previously described, the illustrated embodiments introduce methods of sampling existing data from gaming machines through the use of system and network infrastructure. This sampled data may be compared against thresholds in determining whether the data will be used to re-create notable events. These methods allow for the generation, editing, and delivery of content to the player and the player's associates at a subsequent time by use one or more data processing devices, which, in one embodiment, are generally logically and physically removed from the gaming machine itself, yet are communicative with the gaming machines through network and other means.

In one such embodiment, these data processing devices are dedicated to the capture, creation, editing, and delivery of facsimile event recreations to the player and others. As a result, a single server that is interconnected with banks of EGM's in the gaming environment may harness existing data from the gaming machines, blend the data with on-board software to virtualize the gaming experience to be re-created, edit the generated content, and even deliver the content, for example to a player's mail server. This allows for the implementation of event recreation to be scalable from the smallest to largest gaming environments, and moreover, for such implementation to be cost and resource-efficient.

Considering such an example "event recreation system" as previously described, it is then possible to sample existing data from gaming machines, such as coin-in meter, coin-out meter, game state information, random number generation bits requests, system time, and other data (including incrementation signals), all for the sole purpose of re-creation of notable events experienced by the player. Such data sampling reduces the bandwidth requirements of recording all data generated by the gaming machine, recording (i.e., video recording) the event itself, and the like.

Once the existing data that passes the threshold requirements is sampled and preserved by these data processing devices, it may be processed by software and hardware mechanisms associated with the data processing devices to generate the aforementioned facsimile event re-creations. Depending on the sophistication of the data processing, software, hardware, and other factors that may be put to use, such re-creation may eventually be indecipherable from the real experience to the player. Here again, such processing may be resource scalable, so sophisticated gaming environments may employ more resources to perform event re-creation, while smaller operations may elect to use minimal processing resources to save cost. In either case, the player's wish to re-experience the event is facilitated, and the gaming environment realizes the benefits without exorbitant cost, or necessity to recode, retest, or recertify each game to which the re-creation functionality is to be supplied.

The illustrated embodiments may employ existing system resources as warranted to accomplish this sampling functionality. As such, system-level hardware with supervisory-level control may facilitate the delivery of the data from the individual gaming machines to the dedicated processing devices that will re-create the player's experiences. Here again, this serves to promote installation without incurring cost.

Once the sampled data is provided to be processed for event re-creation, the illustrated embodiments introduce various methods for operators, players, and others to manipulate this data to suit a variety of purposes. For example, the facsimile event re-creation may be editable through the data processing device by predefined rules set by the gaming environment, operators, administrators, players, and others. The facsimile event re-creation may be editable by the gaming operators and administrators. Finally, the facsimile event re-creation may be editable by the player.

Depending on the particular implementation and situation, the player may be granted a large degree of flexibility to edit the re-created content themselves. This also promotes enjoyment and reinforces the notable experience by the player. The player may also be given control over those who the player wishes to share the event with, and through what means. Here again, depending on the situation, the player may use existing social network infrastructure to distribute such content. In addition, the gaming environment increases its visibility and notoriety among those with whom the content is distributed. The gaming environment may use the re-creation of the content as a vehicle to provide incentives to the player, promote the gaming environment, reinforce a particular brand or game, and gain other valuable benefits.

Throughout the following, reference will be made to "system code" and "game code." System code and game code each contain hardware, software, and audio/visual assets; however the system code is generally functional at a higher hierarchical level and in supervisory fashion. As such, the systems assets that are used, for example, in implementing the illustrated embodiments generally will be referred to have "hierarchical supervisory control" over the game code and associated game machine hardware.

To illustrate the functional interrelationship between the two entities, consider the following. Two exemplary EGM's may have equal or near-equal gaming machine hardware, but may offer different game titles. For example, one EGM may carry "Wild Wolf," while the other may carry "100 Pandas." In this situation, while the game hardware is nearly the same or the same, the game code (game software) is significantly different relative to the game title each respectively implements. However, the system code running on the machines is the same or nearly the same. It is this interrelationship that allows for the implementation of the illustrated embodiments across a wide variety of gaming platforms and environments without significantly increased cost.

It should be noted again that in this interrelationship, the target gaming system in which the various EGM's operate is given access to a variety of machine data that is used, for example, to administer the gaming machines using a server/host architecture. As such, this machine data again includes such data as system time, coin-in meter, coin-out meter, game state information, Random Number Generator (RNG) bits requests, and the like. This data is made available by gaming machines to the system entity overseeing the banks of EGMs in the gaming environment. It should be noted that reference to the terminology of "coin-in" and "coin-out" data also contemplates implementations where the system may not use such cumulative values but instead examines corresponding incrementation signals. In these situations, such coin-in and coin-out data as herein referred to and presently claimed refers also to basic incrementation indicators, which may be noted by the system and used herein by the mechanisms of the illustrated embodiments. All told, the illustrated embodiments take advantage of the ready availability of this varied data so as not to encumber the gaming machines with additional hardware and/or software necessary to capture notable gaming events as will be further described in detail, following.

Turning now to FIG. 1, a block diagram illustrating a gaming system environment 100 is shown. Environment 100 includes a Gaming Terminal Data Repository (GTDR) connected via one or more network interface(s) to a gaming network which, for example, may include gaming devices (e.g., gaming terminals) and/or other devices, in which aspects of the present invention may be realized. As illustrated in FIG. 1, the gaming environment 100 may comprise a gaming system/environment 122 located in a physical environment (not shown). It will be appreciated that the communications links between the various components may be separate and distinct or may be commonly used. It will also be appreciated that one or more of the functions or applications described above may be consolidated, such as at a common server or host. Further, other components for implementing other functionality may be provided. For example, a variety of computing devices, such as user stations, may be connected to the various systems. Printers and other peripheral devices may also be connected to each network or system. A gaming system/environment 122 may be located at least partially in one or more physical gaming environments, such as a casino, restaurant, and/or convenience store. For example, the casino may include publicly accessible game areas where certain of the gaming system devices 124, such as gaming machines 125 and table games 127 are located, as well as secure areas where the servers and other components are located.

In one embodiment, the physical environment includes at least a portion of a physical structure, such as casino, housing one or more components of the gaming system/environment 122. The gaming system/environment 122 includes one or more gaming system devices 124 or components. The gaming system devices 124 may include gaming machines 125, such as those known as video or slot machines. The devices 124 may also include "table" games 127 such as Blackjack and Roulette. The gaming devices 124 may also include components or devices such as player tracking card readers 129, coin counters and other gaming devices functionality options, which devices or components may be linked or associated with other devices. The devices or components may also comprise computers or servers and communication equipment, cashier and accounting workstations and a wide variety of other elements.

In one embodiment, the gaming system/environment 122 may include a variety of sub-systems. These sub-systems may be partially or fully independent of one another or may be related. In one embodiment, each system may be included or be part of a network. In one embodiment, the gaming system/environment 122 may include a game presentation/operation system, which includes at least one game server 126. The game server 126 may comprise a computing device including a processor and a memory. The game server 126 may be adapted to perform a variety of functions. This functionality may be implemented by software and/or hardware of the server 126. In one embodiment, the game server 126 may be arranged to provide information or instructions to the one or more gaming devices 124 or individual gaming system components. The information may comprise game code and control data. In one embodiment, the game server 126 may also be arranged to accept information from the gaming devices 124 or components. For example, the game sever 126 may accept information regarding the status of operation of a particular gaming system device 124 (such as "normal," "suspended," "malfunction," available for new wager or unavailable for new wager).

In one embodiment, the game server 126 is part of a network, which includes a communication link between the game server 126 and selected gaming system device(s) 124 and/or other component(s) with which communication is desired. A communication interface may be associated with the game server 126 and each device or component for facilitating the communication. The communication interfaces may have a variety of architectures and utilize a variety of protocols such as IEEE-1394 (FireWire™) or Ethernet in the case where the communication link is a wired link, or a wireless link utilizing a wireless protocol such as WIFI, Bluetooth™, Radio Frequency (RF), Infrared, etc. The communication links may transmit electrical, electromagnetic or optical signals, which carry digital data streams, or analog signals representing various types of information. In one embodiment, such as when the gaming device 124 comprises a gaming machine 125, the device 124 may include a master gaming controller, which controls the functions of game operation. The communication interface may be associated with the master gaming controller, permitting data to be transmitted between the game server 126 and the master gaming controller. In other embodiments, the device 124 may function as more of a coordinator and/or data store than an actual controller.

In one embodiment, the gaming system/environment 122 may include a player tracking system, which includes at least one player-tracking server 128. The player-tracking server 128 may also comprise a computing device including a processor and a memory. The player-tracking server 128 may be adapted to perform player-tracking functions. For example, the player-tracking server 128 may store information regarding the identities of players and information regarding the game play of those players. This information may include time of play, coin in/coin out or other monetary transaction data, and in an arrangement where players are awarded points based on play, a player's point total. Once again, the player tracking system includes a network comprising a communication link provided between the player tracking server 128 and one or more of the gaming devices 124 having a player tracking function or other components of the gaming system/environment 122 associated with the system. In one embodiment, such as where the gaming device 124 comprises a gaming machine, the device may include a management interface board, which controls a card reader. The management interface board may be arranged to receive data from the master gaming controller of the gaming system device 124. A communication interface is associated with the management interface board, permitting data to be transmitted between the player tracking server 128 and the management interface board.

In the case of table games, a card reader 129 may be associated with the table (e.g., the card reader located on or near the table game). Players may utilize the card reader to identify themselves. Information regarding play of the table game may be input through an input device by a dealer, coin counter or the like, and this information may be transmitted to the player tracking server 128.

In one embodiment, the gaming system/environment 122 may include an accounting system, which includes at least one accounting server 130. The accounting server 130 may comprise a computing device including a processor and a memory. The accounting server 130 is preferably adapted to perform financial related functions, such as track financial transactions such as bets and payouts, and perform reconciliations with monies collected from the gaming system devices 124, such as gaming machines 125, tables games 127. The accounting server 130 may be associated with a wide variety of devices, including individual gaming system devices 124 and other servers. Once again, a communication link may be provided between the accounting server 130 and each device with which communications is desired.

In one embodiment, the gaming system/environment 122 may include a progressive award system, which includes at least one progressive server 132. The progressive sever 132 may comprise a computing device including a processor and a memory. The progressive server 132 may be designed to generate progressive award information. In one arrangement, the progressive server 132 may obtain information regarding amounts bet at specific gaming system devices 124, such as gaming machines 125 or table games 127. Utilizing this information, a progressive jackpot award amount may be generated and updated using a specified protocol. The information may be transmitted to one or more displays 134 associated with participating devices 124. Once again, a communication link is preferably provided between the progressive server 132 and each device with which communications is desired. For example, a link may be provided between the progressive server 132 and accounting server 130 for providing payout information to the accounting server 130. The accounting server 130 also reads the paid amounts from the electronic gaming machines 125 as well and makes sure the paid amounts match what the progressive server claimed the paid amounts should have been. If the paid amounts don't match, then the accounting server 130 may raise a flag for further investigation by casino staff or regulators.

A physical and/or virtual information host 136 is associated with or comprises a portion of the gaming system/environment 122. In one embodiment, the host 136 comprises a computing device, which includes a processor, memory and a display. The virtual information host 136 may be one or more devices separate from devices performing other functions of the system/environment 122, or may be integrated with existing devices. The virtual information host 136 may be designed and adapted to perform functions relating to acquiring, managing, rendering, generating and/or displaying real-time and/or non real-time casino gaming system or "gaming environment" graphical information and information regarding one or more components of the gaming system or environment. Such functionality may also include the generation of at least one graphical user interface on at least one mobile device (e.g., 131), which is configured or designed to graphically display information (e.g., real-time casino information) relating to selected aspects of casino activity. Also, different graphical user interfaces may be displayed on an external application, such as on an application of a computer, smart phone, and/or on any type of mobile device 131. In one embodiment, bi-directional communication channels 121 are provided for direct, two-way communication between the host 136 and at least one game server 126 and at least one player-tracking server 128, and/or any other device with which communications is desired.

As illustrated in the example of FIG. 1, gaming system/environment 122 may also include one or more mobile devices 131 configured or designed to communicate, via one or more wireless links 111, with various components of the gaming environment 100 such as, for example: information systems (e.g., virtual information host 136); player tracking systems; accounting systems; employee management systems; location positioning systems (e.g., GPS system 133); game servers; surveillance systems; security systems; communications systems; gaming systems (e.g., gaming machines 125, game table devices 127, other mobile devices 125, etc.); etc.

In view of the foregoing, consider the following additional possible characteristics of the gaming system/environment 122 that may be leveraged in one or more aspects of the illustrated embodiments. Each EGM 125 may have its own "computing hardware" (e.g., game server 126). On this hardware may run several layers of software which may roughly be categorized as either "game software" or "system software" as the case may be and as will be further described in the context of the illustrated embodiments. So-called "game software" may be unique to every game title.

Further, a given EGM 125 may have more than one game loaded, each of which has its own corresponding game software. "System software" as used herein contemplates all hardware drivers, platform management, ability to launch games, ability to payout awards based on game outcomes, and the like.

Still further, The Random Number Generator (RNG) whose bits are used to obtain random game outcomes is, in one embodiment, a systems software component. Code that converts RNG bits into specific outcomes may be a game software or a system software component, based on developer preference. Each EGM 124 may is own communication boar(s) that provide various functionality. Accordingly, in one embodiment, each board may be embodied as gaming system device 124. This functionality may include (1) player tracking, (2) casino monitoring, (3) bank-level communication, such as for a local area progressive or community bonus, and (4) wide-area communication such as wide-area progressives and wide-area bonusing.

In a situation implementing bank-level communication, for example, a comparable computing device may be implemented to perform required cross-EGM data processing and synchronization. This comparable computing device may be embodied as device 124, enclosed and/or housed in EGM 125, or located elsewhere such as in a bank-wide progressive display unit, or possibly be embodied as a software function embedded in one of the communication devices, thus a peer-to-peer connection with one EGM 125 designated as master.

Finally, there are land-based gaming configurations in which two or more EGMs 125 may share a game server 126 or similar device, which is discussed further below. These shared configurations are sometimes referred to as "Central Determination Systems" (CDSs) and/or "Video Lottery Terminals" (VLTs). For secure online client-server gaming where outcomes are determined at a central server location, there is typically only one game server 126 equivalent, which serves all the client's game "stations." Each player's browser, mobile device, etc. then has access to that server 126.

As one of ordinary skill in the art will appreciate, and in view of the aforementioned discussion, the architecture depicted in FIG. 1 may vary according to a particular implementation.

Figure 2:
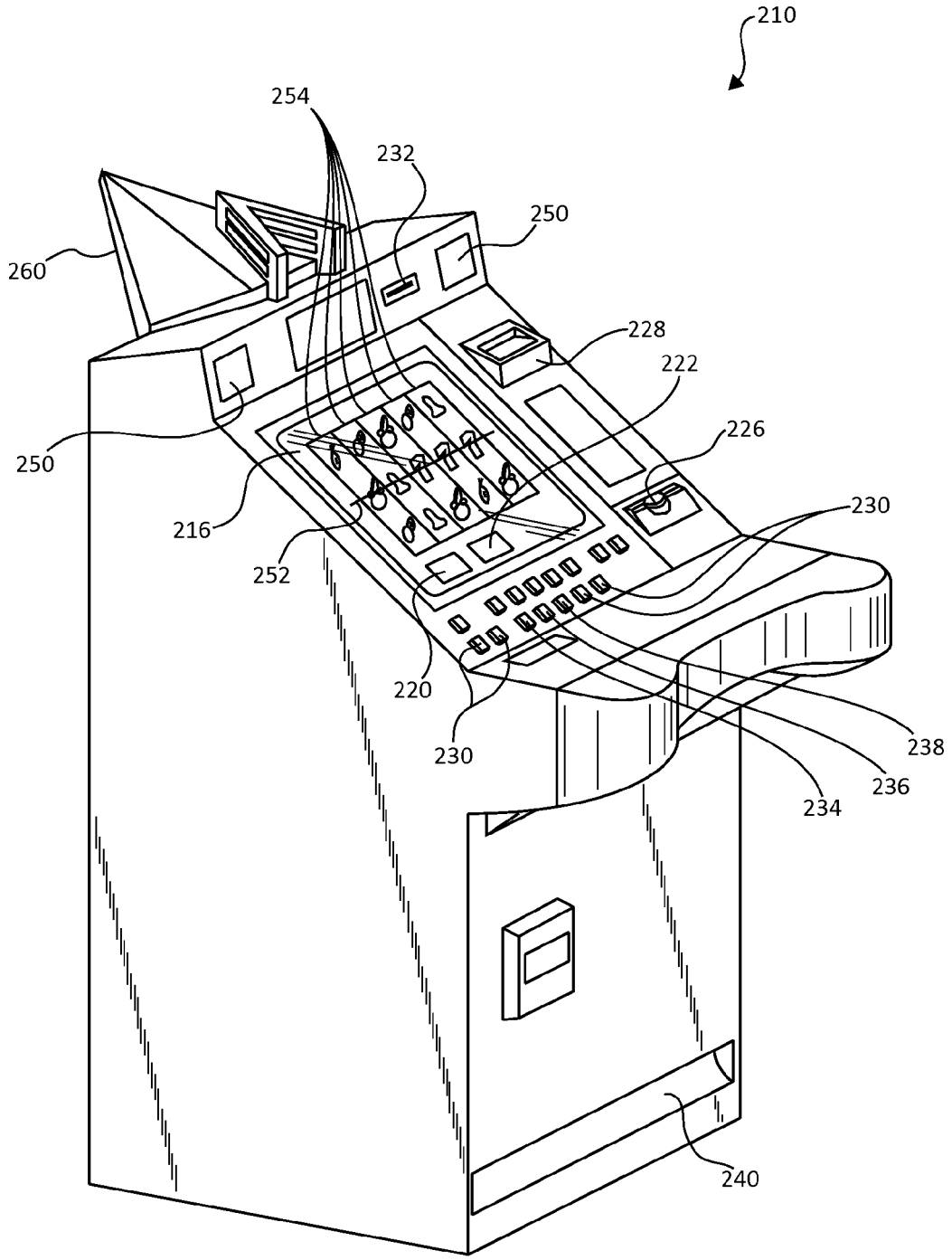
FIG. 2 is a perspective view of one embodiment of a slot machine or gaming device suitable for use in the gaming system of FIG. 1, in which aspects of the present invention may be realized.

FIG. 2 is a perspective view of one embodiment 210 of a slot machine, EGM, or gaming device suitable for use in the previously depicted system of FIG. 1, in which aspects of the present invention may be realized. FIG. 2 represents a base gaming device 210 that can be employed in the shared display system or the gaming system of the present invention is illustrated as gaming device 210. FIG. 2 illustrates features common to each of the gaming devices. In one embodiment, gaming device 210 has a support structure, housing or cabinet, which provides support for a number of displays, inputs, controls and other features of a conventional gaming machine. In the illustrated embodiment, the player plays gaming device 210 while sitting, however, the gaming device is alternatively configured so that a player can operate it while standing or sitting. The illustrated gaming device 210 is positioned on the floor but can be positioned alternatively (i) on a base or stand, (ii) as a pub-style table-top game (e.g., where the participant gaming devices are located remotely from the shared wheel as discussed below), (iii) as a stand-alone gaming device on the floor of a casino with other stand-alone gaming devices, which the player operates while standing or sitting (e.g., where the participant gaming devices are located remotely from the shared wheel as discussed below), or (iv) in any other suitable manner. The gaming device 210 can be constructed with varying cabinet and display configurations. Also, referring to an embodiment for the electronic configuration of gaming device 210, each gaming device may include the components described below in FIG. 3A and FIG. 3B.

In one embodiment, each gaming device 210 randomly generates awards and/or other game outcomes based on probability data. That is, each award or other game outcome is associated with a probability and each gaming device generates the award or other game outcome to be provided to the player based on the associated probabilities. Since each gaming device 210 generates outcomes randomly or based upon a probability calculation, there is no certainty that the gaming device 210 will provide the player with any specific award or other game outcome.

In another embodiment, as discussed in more detail below, each gaming device 210 employs a predetermined or finite set or pool of awards, progressive awards, prizes or other game outcomes. As each award or other game outcome is provided to the player, the gaming device 210 removes the provided award or other game outcome from the predetermined set or pool. Once removed from the set or pool, the specific provided award or other game outcome cannot be provided to the player again. The gaming device 210 provides players with all of the available awards or other game outcomes over the course of the play cycle and guarantees a designated amount of actual wins and losses.

Figure 3A:
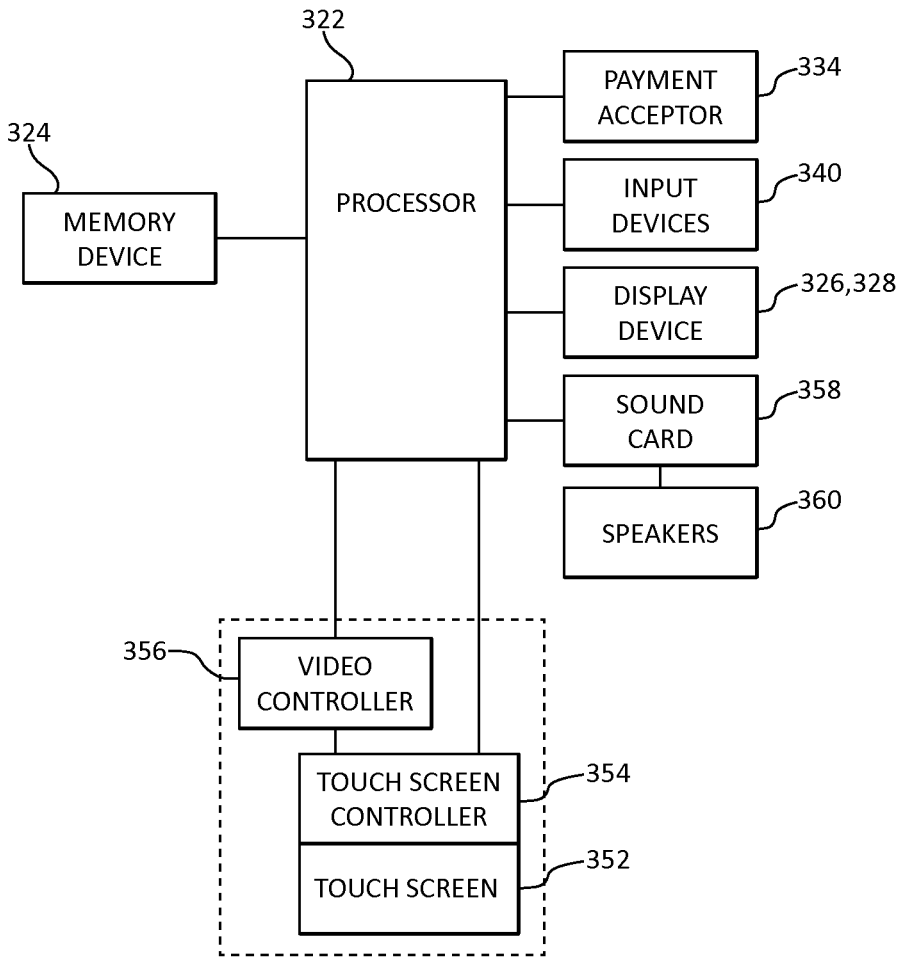
FIG. 3A is a block diagram illustrating an electronic configuration for use in the gaming device of FIG. 2, in which aspects of the present invention may be realized.

As seen in FIG. 2, the gaming device 210 includes a credit display 220 that displays a player's current number of credits, cash, account balance or the equivalent. In one embodiment, gaming device 210 includes a bet display 222 that displays a player's amount wagered. As illustrated in FIG. 3A, in one embodiment, each gaming device 210 includes at least one payment acceptor 334 (FIG. 3A) that communicates with processor 322 (FIG. 3A).

As seen in FIG. 2, the payment acceptor 334 (FIG. 3A) in one embodiment includes a coin slot 226, where the player inserts coins or tokens, and a ticket, note or bill acceptor 228, where the player inserts a bar-coded ticket, note, or cash. In one embodiment, a player-tracking card, credit card, debit card or data card reader/validator 232 is also provided for accepting any of those or other types of cards.

In one embodiment, a player inserts an identification card into card reader 232 of gaming device 210. The identification card can be a smart card having a programmed microchip or a magnetic strip coded with a player's identification, credit totals and other relevant information. In one embodiment, money may be transferred to gaming device 10 through an electronic fund transfer and card reader 232 using the player's credit, debit or smart card. When a player funds gaming device 210, processor 322 (FIG. 3A) determines the amount of funds entered and the corresponding amount is shown on the credit or other suitable display as described above. In one embodiment, after appropriate funding of gaming device 210, the player presses a play button 234 or pull arm (not illustrated) to start any primary game or sequence of events. In one embodiment, upon appropriate funding, gaming device 210 begins game play automatically. In another embodiment, the player needs to actuate or activate one of the play buttons to initiate play of gaming device 210.

As shown in FIG. 2, a bet one button 236 is provided. The player places a bet by pushing bet one button 236. The player increases the player's wager by one credit each time the player pushes bet one button 236. When the player pushes the bet one button 236, the number of credits shown in the credit display 220 decreases by one, and the number of credits shown in the bet display 222 increases by one. A max bet max button (not shown) can also be provided, which enables the player to bet the maximum wager (e.g., max lines and max wager per line). Gaming device 210 may include other suitable wager buttons 230, such as a max bet button, a repeat bet button, one or more select paylines buttons and one or more select wager per payline buttons.

In one embodiment, a cash out button 238 is provided. The player presses cash out button 238 and cashes out to receive a cash payment or other suitable form of payment corresponding to the number of remaining credits. The player can receive coins or tokens in a coin payout tray 240 or a ticket or credit slip, which are redeemable by a cashier or funded to the player's electronically recordable identification card. Each gaming device 210 also includes one or a plurality of communication ports for enabling communication of a processor with one or more external peripherals, such as external video sources, expansion buses, expansion games or other displays, an SCSI port or a key pad.

In one embodiment of FIG. 2, in combination with in FIG. 3A, a touch-screen 352 (FIG. 3A) is provided in one embodiment and operates with a touch-screen controller 354, processor 322 (FIG. 3A) and display device 326,328 (FIG. 3A). Touch-screen 352 (FIG. 3A) and the touch-screen controller 354 are also connected to a video controller 356. The player touches touch-screen 352 at appropriate places to input decisions and signals into processor 322 of gaming device 210. Also, each gaming device 210 may include a sound generating device controlled by one or more sounds cards 258, which function in conjunction with processor 322

(FIG. 3A). In one embodiment, the sound generating device includes at least one speaker 250 or other sound generating hardware and/or software for generating sounds, such as playing music for the primary and/or secondary game or for other modes of the gaming device, such as an attract mode. In one embodiment, each gaming device 210 provides dynamic sounds coupled with attractive multimedia images displayed on display device 216 to provide an audio-visual representation or to otherwise display full-motion video with sound to attract players to gaming device 210. During idle periods, the gaming device 210 displays a sequence of audio and/or visual attraction messages to attract potential players to gaming device 210. The videos in one embodiment are customized to provide information concerning the shared display of the present invention as discussed below.

In one embodiment, gaming device 210 includes a camera in communication with a processor, which is positioned to acquire an image of a player playing gaming device 10 and/or the surrounding area of gaming device 10. In one embodiment, the camera may be configured to selectively acquire still or moving (e.g., video) images and may be configured to acquire the images in either an analog, digital or other suitable format. Display device 216 may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

In one embodiment, as illustrated in FIG. 2, a base or primary game includes a slot game with one or more paylines 252. Paylines 252 may be horizontal, vertical, circular, diagonal, angled or any combination thereof. For a slot game, gaming device 210 displays at least one reel and preferably a plurality of reels 254, such as three to five reels, in either electromechanical form with mechanical rotating reels or in video form with simulated reels and movement thereof. Each reel 254 displays a plurality of indicia such as bells, hearts, fruits, numbers, letters, bars or other images, which preferably correspond to a theme associated with the gaming device. With a slot game, gaming device 10 awards prizes when reels 254 stop spinning and display a winning or paying symbol or combination of symbols on an active payline 252.

In one embodiment, each gaming device 210 includes indicators 260. Indicators 260 reside on the top of each gaming device 10 and point to or indicate one of the awards or outcomes on top of shared display (not shown) when the shared display stops spinning to reveal randomly or otherwise generated results or outcomes. Indicators 260 may illuminate differently at different times or states for the gaming device 210. The illumination of the indicator 260 in one embodiment depends upon whether the gaming device 210 is playing a base game, is in a state in which the player is eligible to play the shared display bonus, is in a state in which the player has committed to play the shared display bonus or is in a state in which the player has declined to play a particular upcoming shared display bonus, as well as other states discussed below.

FIG. 3A is a block diagram illustrating an electronic configuration for use in the gaming device of FIG. 2, here again in which aspects of the present invention may be realized. In the embodiment illustrated in FIG. 3A the player station may include at least one processor 322, such as a microprocessor, a microcontroller-based platform, a suitable integrated circuit or one or more ASICs. The processor 322 is in communication with or operable to access or to exchange signals with at least one data storage or memory device 324. In one embodiment, the processor 322 and the memory device 324 reside within the cabinet of the player station. The memory device 324 stores program code and instructions, executable by the processor 322, to control the player station. The memory device 324 also stores other data such as image data, event data, player input data, random or pseudo-random number generators, pay-table data or information and applicable game rules that relate to the play of the player station. In one embodiment, the memory device 324 includes random access memory (RAM), which can include non-volatile RAM (NVRAM), magnetic RAM (MRAM), ferroelectric RAM (FeRAM) and other forms as commonly understood in the gaming industry. In one embodiment, the memory device 324 includes read only memory (ROM). In one embodiment, the memory device 324 includes flash memory and/or EEPROM. Any other suitable magnetic, optical and/or semiconductor memory may operate in conjunction with the player station and gaming system disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming system is operable over a wireless network, such as part of a wireless gaming system. In this embodiment, the player station may be a hand held device, a mobile device or any other suitable wireless device that enables a player to play any suitable game at a variety of different locations. It should be appreciated that a player station as disclosed herein may be a device (e.g., EGM) that has obtained approval from a regulatory gaming commission or a device that has not obtained approval from a regulatory gaming commission. It should be appreciated that the processor and memory device may be collectively referred to herein as a "computer" or "controller."

In one embodiment, a background play feature may be available where a player, who may be sitting at the lounge and/or at the bar with friends (at the casino) may be playing a machine from the floor by remote via the external application (e.g., a smart phone). The player may substitute into the same game he wanted from an IGT® online game and play, or backend the actual game though a venue network. The game may be bankrolled by the venue the player was inside. If the player was to win the player could collect from that venue where the player was located, and/or instead of "reserving" a machine he could continue the game with an auto play during a period of time the player took a break/recess. In one embodiment, a team game may be played by a group of players (e.g., a group of 3 or 4 players) and the group of players may watch and/or play the same game on each players individual external device (e.g., a computer and/or smart phone). Similarly, as described above, the team game may be played by a group of players from a remote location (e.g., bar, lounge, casino, home, office, restaurant, etc.). In one embodiment, the team game may be played by a group of players and the group of players may share credit inputs and wins. In one embodiment, the team game may be played by the group of players and the group of players may sell off and/or share double up options and/or credits to others team players of the group.

In addition to the foregoing embodiment, other "online" gaming configurations are contemplated in which the mechanisms of the present invention may be implemented in various fashion. In an additional configuration, a "true online cash gaming" environment is contemplated, where a player's personal device is utilized, whether personal computer (PC), laptop, smart phone, cellphone, tablet, and the like, within a legal jurisdiction. Recent trends suggest that these configurations may continue to proliferate as certain jurisdictions authorize such gaming. In still an additional embodiment, an online gaming environment using virtual currency is contemplated, such as virtual currency-based gaming currently occurring over social networking mechanisms.

In one embodiment, as discussed in more detail below, the gaming device randomly generates awards and/or other game outcomes based on probability data. In one such embodiment, this random determination is provided through utilization of a Random Number Generator (RNG), such as a true random number generator, a pseudo random number generator or other suitable randomization process. In one embodiment, each award or other game outcome is associated with a probability and the player station generates the award or other game outcome to be provided to the player based on the associated probabilities. In this embodiment, since the player station generates outcomes randomly or based upon one or more probability calculations, there is no certainty that the player station will ever provide the player with any specific award or other game outcome. In another embodiment, each award or other game outcome is associated with a probability and the central controller or server generates the award or other game outcome to be provided to the player based on the associated probabilities. In one embodiment, each of the player stations includes an RNG and the central server controls the display of the central display. It should be appreciated there may be one or more RNG's per: (a) display segment; (b) central display; (c) player station; (d) number of games; (e) the number of potential games; or (f) any combination of the above. It should also be appreciated that one or more processors may work together and communicate to accomplish any suitable function of the gaming system.

In another embodiment, the gaming system employs a predetermined or finite set or pool of awards or other game outcomes. In this embodiment, as each award or other game outcome is provided to the player, the central controller flags or removes the provided award or other game outcome from the predetermined set or pool. Once flagged or removed from the set or pool, the specific provided award or other game outcome from that specific pool cannot be provided to the player again. This type of gaming system provides players with all of the available awards or other game outcomes over the course of the play cycle and guarantees the amount of actual wins and losses.

In one embodiment, as mentioned above and seen in FIG. 3A, one input device is a touch-screen 352 coupled with a touch-screen controller 354, or some other touch-sensitive display overlay to allow for player interaction with the images on the display. The touch-screen and the touch-screen controller are connected to a video controller 356. A player can make decisions and input signals into the player station by touching the touch-screen at the appropriate places. One such input device is a conventional touch-screen button panel. In another embodiment, a plurality or each of the display segments is a touch-screen 352 coupled with a touch-screen controller 354 or some other touch-sensitive display overlay to allow for player interaction with the images on the display segments. The touch-screens 352 and the touch-screen controllers 354 are connected to a video controller. The player station may further include a plurality of communication ports for enabling communication of the processor with external peripherals, such as external video sources, expansion buses, game or other displays, an SCSI port or a key pad. In one embodiment, at least one payment acceptor 324 that communicates with processor 322 for playing a bet, input devices 340, and display devices 326, 328 are provided.

The player stations, the central controller and the display segments may include serial interfaces and/or ethernet (e.g., G2S (game-to-system) protocol uses commodity Ethernet equipment and TCP/IP) to connect to specific subsystems or subnets internal and external to the player stations, central controller and the display segments. The serial devices may have electrical interface requirements that differ from the "standard" EIA serial interfaces provided by general-purpose computers. These interfaces may include EIA, EIA, Fiber Optic Serial, optically coupled serial interfaces, current loop style serial interfaces, etc. In addition, to conserve serial interfaces internally in the player station, serial devices may be connected in a shared, daisy-chain fashion where multiple peripheral devices are connected to a single serial channel.

The serial interfaces and/or ethernet (e.g., G2S (game-to-system) protocol uses commodity Ethernet equipment and TCP/IP) may be used to transmit information using communication protocols that are unique to the gaming industry. For example, SAS is a communication protocol used to transmit information, such as metering information, from a player station to a remote device. Often SAS is used in conjunction with a player tracking system. EGMs may be treated as peripheral devices to a casino communication controller and connected in a shared daisy chain fashion to a single serial interface and/or ethernet. In both cases, the peripheral devices are preferably assigned device addresses. If so, the serial controller circuitry must implement a method to generate or detect unique device addresses. In one embodiment, security-monitoring circuits detect intrusion into a player station or gaming station by monitoring security switches attached to access doors in a designated area, such as a player station cabinet. In one embodiment, access violations result in suspension of game play and can trigger additional security operations to preserve the current state of game play. These circuits also function when power is off by use of a battery backup. In one embodiment, as seen in FIG. 3A, the player station includes a sound generating device controlled by one or more sounds cards 358 which function in conjunction with the processor. In one embodiment, the sound generating device includes at least one and preferably a plurality of speakers 360 or other sound generating hardware and/or software for generating sounds, such as playing music for the primary and/or secondary game or for other modes of the player station, such as an attract mode. In one embodiment, the player station provides dynamic sounds coupled with attractive multimedia images displayed on one or more of the display devices to provide an audio-visual representation or to otherwise display full-motion video with sound to attract players to the player station. During idle periods, the player station may display a sequence of audio and/or visual attraction messages to attract potential players to the player station. The videos may also be customized for or to provide any appropriate information.

In one embodiment, the gaming system may include a sensor, such as a camera in communication with the processor (and possibly controlled by the processor) that is selectively positioned to acquire an image of a player actively using the player station and/or the surrounding area of the player station. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia. In another embodiment, the gaming system includes a wireless transceiver or a camcorder and the display segments are components of or are connected to televisions, satellites, DVD players, digital video recorders and Internet-enabled devices. In one embodiment, the game may be displayed on the central display and replicated on one or more the player stations. In another embodiment, the game is only displayed on the central display and the player station is only used to input decisions or commands in the game. In another embodiment, a primary or base game is displayed on the player station and/or the central display and one or more bonus games are displayed on the central display only. In one embodiment, the player stations provide other information to a player, such as the win/loss history of that certain games or the win/loss history of that player. It should be appreciated that the central display and the player stations may work together with a central controller or a plurality of servers to provide the games to the player in any suitable manner.

Figure 3B:
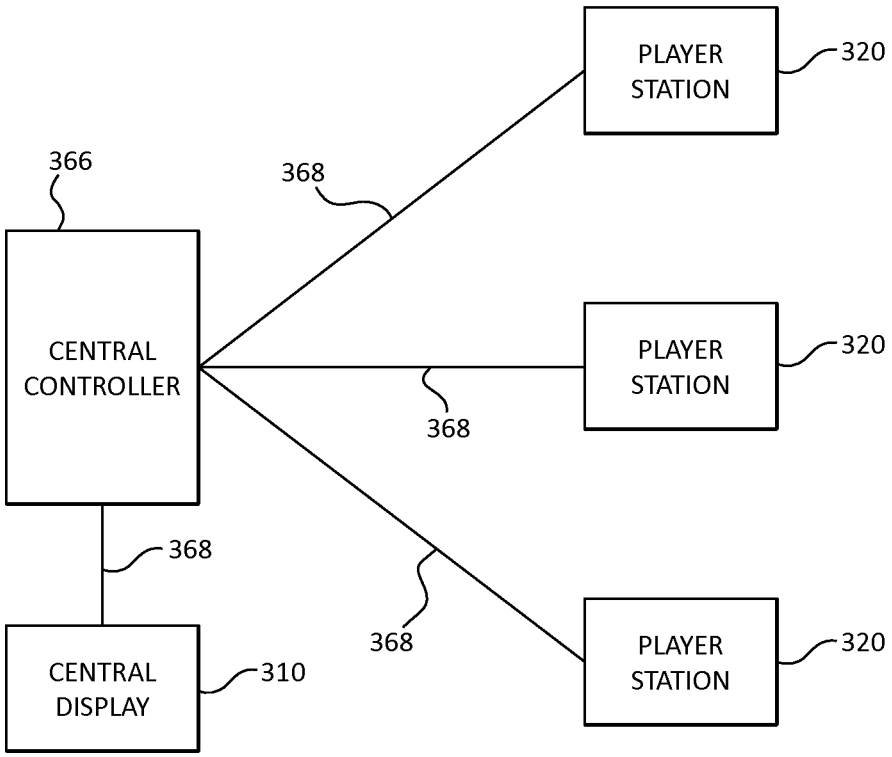
FIG. 3B is a block diagram illustrating player stations in communication with a central controller and a central display in communication with the central controller for use in the gaming device of FIG. 2, in which aspects of the present invention may be realized.

FIG. 3B is a block diagram illustrating a player station 320 in communication with a central controller and a central display 310 in communication with the central controller for use in the gaming device of FIG. 2, in which aspects of the present invention may be realized. In one embodiment, as illustrated in FIG. 3B, one or more of the player stations 320 are in communication with each other and/or at least one central server, central controller or remote host 366 through a data network or remote communication link 368. The central server, central controller or remote host is any suitable server or computing device, which includes at least one processor and at least one memory or storage device, and may also be in communication with a central display 310. In other embodiments, the central server is a progressive controller or a processor of one of the player stations in the gaming system. In these embodiments, the processor of each player station is configured to transmit and receive events, messages, commands, a current progressive value or any other suitable data or signal between the individual player station and the central server. The player station processor is operable to execute such communicated events, messages or commands in conjunction with the operation of the player station. Moreover, the processor of the central server is configured to transmit and receive events, messages, commands or any other suitable data or signal between the central server and each of the individual player stations. The central server processor is operable to execute such communicated events, messages or commands in conjunction with the operation of the central server. It should be appreciated that one or more of each of the functions of the central controller may be performed by one or more player station processors. It should be further appreciated that one, more or each of the functions of one or more player station processors as disclosed herein may be performed by the central controller. In one embodiment, the central controller has an Uninterruptible Power Supply ("UPS"). In one embodiment, the UPS is a rack mounted UPS module.

In one embodiment, the game outcome provided to the player is determined by a central server or controller and provided to the player at the player station. In this embodiment, each of the player stations is in communication with the central server or controller. Upon a player initiating game play at one of the player stations, the initiated player station communicates a game outcome request to the central server or controller. In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. The central server or controller is capable of storing and utilizing program code or other data similar to the processor and memory device of the player station. In an alternative embodiment, the central server or controller maintains one or more predetermined pools or sets of predetermined game outcomes. The central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes. The central server or controller communicates the generated or selected game outcome to the initiated player station. The player station receives the generated or selected game outcome and provides the game outcome to the player. In an alternative embodiment, how the generated or selected game outcome is to be presented or displayed to the player, such as a reel symbol combination of a player station or a hand of cards dealt in a card game, is also determined by the central server or controller and communicated to the initiated player station to be presented or displayed to the player. Central production or control can assist a gaming establishment or other entity in maintaining appropriate records, controlling gaming, reducing and preventing cheating or electronic or other errors, reducing or eliminating win-loss volatility.

In one embodiment, the player stations disclosed herein are associated with or otherwise integrated with one or more player tracking systems. In this embodiment, the player station and/or player tracking system tracks players gaming activity at the player station. In one such embodiment, the player station and/or associated player tracking system timely tracks when a player inserts their playing tracking card to begin a gaming session and also timely tracks when a player removes their player tracking card when concluding play for that gaming session. In another embodiment, rather than requiring a player to insert a player-tracking card, the player station utilizes one or more portable devices carried by a player, such as a cell phone, a radio frequency identification tag or any other suitable wireless device to track when a player begins and ends a gaming session. In another embodiment, the player station utilizes any suitable biometric technology or ticket technology to track when a player begins and ends a gaming session. During one or more gaming sessions, the player station and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. The player stations are capable of being connected together through a data network. In one embodiment, the data network is a local area network (LAN), in which one or more of the player stations are substantially proximate to each other and an on-site central server or controller as in, for example, a gaming establishment or a portion of a gaming establishment. In another embodiment, the data network is a wide area network (WAN) in which one or more of the player stations are in communication with at least one off-site central server or controller. The player stations may be located in a different part of the gaming establishment or within a different gaming establishment than the off-site central server or controller. Thus, the WAN may include an off-site central server or controller and an off-site player station located within gaming establishments in the same geographic area, such as a city or state. The WAN gaming system may be substantially identical to the LAN gaming system described above, although the number of player stations in each system may vary relative to each other.

In one embodiment, as a benefit to one or more of the gaming venues (e.g., a casino), using the player tracking system, along with use of the GPS positioning, for identifying the movements of the players throughout the gaming venues, identifying cash, money, credits, and award amounts spent along with various trends (e.g., historical) for generating visual graphs while displaying showing top view of the gaming venue (e.g., looking down from above the gaming venue) to improve casino layouts and identify patterns an movements of all types of players.

In another embodiment, the data network is an Internet or intranet. The operation of the player station can be viewed at the player station with at least one Internet browser. Operation of the player station and accumulation of credits may be accomplished with only a connection to the central server or controller (the internet/intranet server) through a conventional phone or other data transmission line, digital subscriber line (DSL), T-1 line, coaxial cable, fiber optic cable, WIFI, or other suitable connection. Players may access an Internet game page from any location where an Internet connection and computer, or other Internet facilitator is available. The expansion in the number of computers and number and speed of Internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, as described above, the gaming system is in communication with a central server or controller. The central server or controller may be any suitable server or computing device, which includes at least one processor and a memory or storage device. In alternative embodiments, the central server is a progressive controller or another player station in the gaming system. In one embodiment, the memory device stores different game programs and instructions, executable by a player station processor, to control the player station. Each executable game program represents a different game or type of game, which may be played on one or more of the player stations in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the player station) or vice versa.

In this embodiment, one, all or a plurality of the player stations at least includes one or more display devices and/or one or more input devices for interaction with a player. A local processor, such as the above-described player station processor or a processor of a local server, is operable with the display device(s) and/or the input device(s) of one or more of the player stations. In operation, the central controller is operable to communicate one or more of the stored game programs to at least one local processor. In different embodiments, the stored game programs are communicated or delivered by embedding the communicated game program in a device or a component (e.g., a "chip" to be inserted in a player station), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the player station. That is, when a game program is communicated to a local processor, the local processor changes the game or type of game played at the player station or displayed on the display segment. Though the illustrated embodiments are described with the central controller determining a game result for the player and communicating that result to the central display 310 and one or more player stations, any other suitable game determining method may be employed in any embodiment of the present disclosure. In one embodiment, the central display 310 is associated with a central display 310 server. This central display 310 server determines the game outcome for the games played on each of the display segments. The central display 310 server communicates the game outcome to the central controller, which communicates the game outcome to one or more of the player stations.

In one embodiment, the central controller determines the award to provide to the player based on the game outcome. In another embodiment, the player stations determine the award and/or progress jackpot/value to provide to the players based on the game outcomes. In another embodiment, the central controller determines the game outcome displayed on the central display 310 and the player station determines any award and/or progress jackpot/value to provide to the player based on the game outcome. The player station determines both the game outcome and any award to provide to the player based on the game out come. In another embodiment, the central controller determines part of the outcome and the player station determines part of the outcome. That is, both the central controller and the player station determine part of a player's outcome and/or award.

Further, in the gaming industry, many different manufacturers make gaming machines and player stations. The communication protocols on the player station may be hard-wired into the player station and each player station/gaming machine manufacturer may utilize a different proprietary communication protocol. A player station manufacturer may also produce host systems, in which case their player stations are compatible with their own host systems. However, in a heterogeneous gaming environment, player stations from different manufacturers, each with its own communication protocol, may be connected to host systems from other manufacturers, each with another communication protocol. Therefore, communication compatibility issues regarding the protocols used by the player stations in the system and protocols used by the host systems must be considered.

In another embodiment, player stations at one or more gaming sites may be networked to a central server in a progressive configuration, wherein a portion of each wager to initiate a base or primary game may be allocated to bonus or secondary event awards. In one embodiment, a host site computer is coupled to central servers at a variety of mutually remote gaming sites for providing a multi-site linked progressive automated gaming system. The host site computer may serve player stations distributed throughout a number of properties at different geographical locations including, for example, different locations within a city or different cities within a state. The host site computer may be maintained for the overall operation and control of the system. A host site computer may oversees the entire progressive gaming system and may be the master for computing all progressive jackpots and values for each and every gaming device. All participating gaming sites report to, and receive information from, the host site computer. Each central server computer may be responsible for all data communication between the player station hardware and software and the host site computer. An individual player station may trigger a progressive win, for example through a game play event such as a symbol-driven trigger in the multi-component game. The central server or other central controller determines when a progressive win is triggered. The central controller and an individual player station may work in conjunction with each other to determine when a progressive win is triggered, for example through an individual player station meeting a predetermined requirement established by the central controller. The progressive award win may be triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a player station is randomly or apparently randomly selected to provide a player of that player station one or more progressive awards. In one such embodiment, the player station does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game. In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards).

In one such embodiment, the greater the players' wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner. In another embodiment, one or more of the progressive awards are partially funded via a side-bet or side-wager, which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed. In one alternative embodiment, a minimum wager level is required for a player station to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, players at a linked player stations in a gaming system participate in a group gaming environment. In one embodiment, players at linked player stations work in conjunction with one another, such as playing together as a team or group, to win one or more awards. In one such embodiment, any award won by the group is shared, either equally or based on any suitable criteria, amongst the different players of the group. In another embodiment, players linked player stations compete against one another for one or more awards. In one such embodiment, players at linked player stations participate in a gaming tournament for one or more awards. In another embodiment, players at linked player stations play for one or more awards wherein an outcome generated by one player station affects the outcomes generated by one or more linked player stations.

Figure 4:
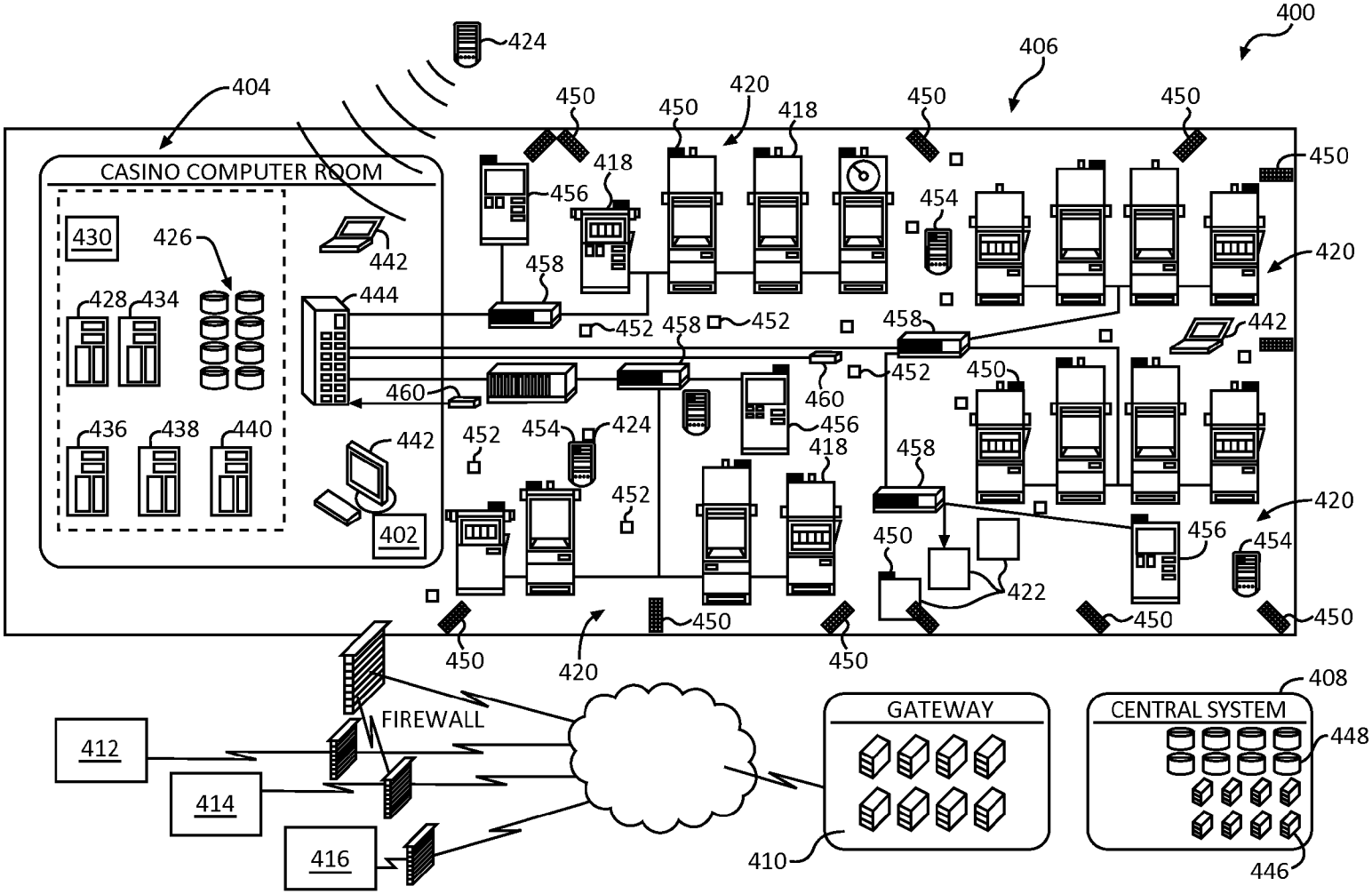
FIG. 4 is a schematic block diagram of a server-based gaming network in which aspects of the present invention may be realized.

FIG. 4 is a schematic block diagram of a server-based gaming network 400 in accordance with an exemplary embodiment of the present invention. In the exemplary embodiment, network 400 includes a slot floor mix recommendation system 402 incorporated therein. In one embodiment, slot floor mix recommendation system 402 is a stand-alone system communicatively coupled to network 400. In various embodiments, slot floor mix recommendation system 402 is incorporated within various components of network 400. Network 400 provides methods and devices for managing one or more networked gaming establishments. Network 400 may be embodied in what is known as a server-based gaming network, sbX™ network. For example, in one embodiment, a host may be included in the network, such as a server-based gaming network. For example, a gaming server (e.g., an sbX™ server) may be an example of the host. The gaming server (e.g., the sbX™ server) may be a set of servers running central applications and may attach as the host to EGMs via the gaming network. In one embodiment, a host, operating in the gaming network, may be a server (e.g., an sbX™ server) managing and controlling the gaming network (e.g., an sbX™ network). In one embodiment, the host, operating in the gaming network, may monitor the monetary activity of the EGM. The host may track any error conditions on the EGM. The host may configure the EGM such as to enable/disable games, download games, and configure game parameters (denomination, payback, etc.). For example, a gaming management solution (e.g., IGT® sbX™ gaming management solution) may be a server-based system to act as a repository for all game content that may be downloaded to EGMs giving each EGM instant access to the technology within the EGM's environment. The game software, random number generator and game logic are controlled by the EGM. This significantly increases configuration speed so that games may be adapted and seamlessly integrate analytics to the database in minutes. Game titles are accessed from the server using a floor manager (e.g., IGT Floor Manager®), running on the host, and allow operators to reconfigure their gaming floor almost instantly. In one embodiment, the floor manager, operating on the host, is a G2S-compliant game-to-system management solution that enables operators to remotely change the game mix on the casino floor. In one embodiment, the floor manager application provides operators with sophisticated and user-friendly visualization tools to analyze terminal (e.g., the EGM) and game performance in real-time. Using Quick Change functionality (QCF), the floor manager, running on the host server(s), enables operators to rapidly locate low performing games, select a new theme from the game library and download the new theme on the EGM in the gaming venue floor within minutes. The software displays a map of the casino floor and highlights EGMs color-coded to indicate performance. Operators can select individual terminals and receive analysis at terminal-, multi-game and single-game level, based on KPIs such as coin-in, actual win and occupancy of game. In one embodiment, the floor manager application is a gateway to a game-to-system library allowing operators to quickly schedule changes or switch between themes. Once selected, the game's configurations can be set including denomination, max bet and even volume and credit limits on the EGM. For example, new gaming industry-leading themes may be added to the game library every month and the floor manager application provides rapid deployment to the gaming floor to ensures an EGM will maintain high performance and continually provide the user with newer and advanced games to add to the users favorite and/or preferred games. In one embodiment, the quick recognition and eradication of low performing games and ability to respond to consumer requests on the floor, empowers a gaming venue to concentrate on player satisfaction and gaming experience.

In addition, with the sbX™ gaming management, as each EGM connected to the system is self-sufficient, if there is a malfunction or connectivity fault, information is backed up at the individual EGM for a predetermined period of time (e.g., two weeks), ensuring no data loss. Once the problem is resolved and the EGM is re-connected to a server, the backed-up data is instantly dropped into the database. Operators now have the ability to run their own choice of games on any interconnected terminal in the gaming venue. This allows management to switch between games at any time, delivering an unmatched level of flexibility and control over their gaming environment. Users are also able to select the games (e.g., a favorite and/or preferred EGM) and denominations they wish to play at the terminal. In one embodiment, the sbX™ gaming management system delivers a flexible and diversified approach to management and control of the casino floor, reconfiguring gaming machines at the appropriate time and schedule. For example, in one embodiment, all EGMs connected to the server are granted full access to themes held in a games depository and operators can reconfigure each terminal remotely from the workstation. A Games Library may be included and may contain over 300 gaming titles in a game-to-system depository. In one embodiment, the sbX™ gaming management application allows for games to be updated in minutes and with this simple configuration process in place, operators can place better focus on in-depth player statistics. Accurate information in real-time optimizes marketing strategies, to provide the ultimate gaming experience and ensure the floor remains dynamic. Instantaneous analysis and decisions may be implemented to adjust elements and increase user satisfaction and loyalty. This also enables a gaming venue to ensure users are able to play the latest content available. Various game themes can be changed, tested and reverted in different areas of the gaming venue with rapid execution. In one embodiment, the sbX™ application and its integrated modules provide for data analysis and also focus on player experience thereby allowing for the development of innovative marketing programs. For example, in one embodiment, certain banks of machines may be adapted to a featured game, linked to a proprietary progressive jackpot and then heavily promoted during certain times. Thus, these games may become a favorite and preferred EGM during a particular time. Following the promotion, the EGMs can quickly be restored to their original games. In one embodiment, the sbX™ system may be driven by IGT's Advanced Video Platform (AVP®) with the technology seamlessly integrated with all modules, permitting fast connectivity and advanced capabilities. In addition, GSA open protocols are used so that sbX™ applications are interoperable with third-party devices that have also adopted GSA open protocols.

Thus, in one embodiment, if a demand for a particular type of the EGM is in high demand (e.g., multiple users are selecting a favorite and/or preferred game on a particular EGM) but the supply of the favorite and/or preferred game on a particular EGM is low, the floor manager application provides the ability to quickly (e.g., within minutes) update and replace the EGM's having low performing games and/or non-preferred games on the EGM with the higher performing and/or favorite and preferred game on a particular EGM.

In one embodiment, network 400 permits the convenient provisioning of networked gaming machines and other devices relevant to casino operations. Game themes may be easily and conveniently added or changed, if desired. Related software, including but not limited to player tracking software and peripheral software may be downloaded to networked gaming machines, mobile gaming devices, thin clients and/or other devices, such as kiosks, networked gaming tables, player stations.

In some implementations, servers or other devices of a central system will determine game outcomes and/or provide other wager gaming functionality. In some such implementations, wagering games may be executed primarily on one or more devices of a central system, such as a server, a host computer, etc. For example, wager gaming determinations, such as interim and final game outcomes and bonuses, may be made by one or more servers or other networked devices. Player tracking functions, accounting functions and some display-related functions associated with wagering games may be performed, at least in part, by one or more devices of a casino network and/or of a central system.

In the exemplary embodiment, network 400 includes a casino computer room 404 and networked devices of a gaming establishment 406. Gaming establishment 406 is configured for communication with a central system 408 via a gateway 410. Other gaming establishments 412, 414, and 416 are also configured for communication with central system 408.

Gaming establishment 406 includes multiple gaming machines 418. Some of gaming machines 418 form a cluster or "bank" 420 of gaming machines 418. Gaming machines 418 are configured for communication with one or more devices of casino computer room 404 or similar devices disposed elsewhere in gaming establishment 406. Some of gaming machines 418 may be configured to read from, and/or write information to, a portable instrument such as but not limited to, a ticket and a player loyalty device. In one embodiment, gaming establishment 406 also includes a bank of networked gaming tables 422. However, network 400 may be implemented in gaming establishments having any number of gaming machines, gaming tables, etc. It will be appreciated that many gaming establishments 406 include hundreds or even thousands of gaming machines 418, gaming tables 422 and/or mobile devices 424, not all of which are necessarily associated bank 420 and some of which may not be connected to network 400. At least some of gaming machines 418 and/or mobile devices 424 may be "thin clients" that are configured to operate, at least in part, according to instructions from another device (such as a server).

Multiple storage devices 426, sbX™ server 428, License Manager 430, servers 434, 436, 438, and 440, host device(s) 442, and main network device 444 are disposed within computer room 404 of gaming establishment 406. In practice, more or fewer devices may be used. Depending on the implementation, some such devices may reside elsewhere in gaming establishment 406.

One or more of the devices in computer room 404 (or similar devices disposed elsewhere in gaming establishment 406 or in gaming establishment 412, 414, or 416) may be configured to provide functionality relevant to embodiments of the present invention. For example, one or more of servers 434, 436, 438, or 440 may be configured for communication with gaming machines 418 that are configured to provide a subset of themes for selection by a player. For example, one or more such servers may be configured to provide a selection of a subset of four themes from a large number of available themes.

Accordingly, in some embodiments at least some gaming establishments may be configured for communication with one another. In this example, gaming establishments 412, 414, and 416 are configured for communication with casino computer room 404. Such a configuration may allow devices and/or operators in casino 406 to communicate with and/or control devices in other casinos. In some such implementations, a server (or another device) in computer room 404 may be configured to communicate with and/or control devices in gaming establishments 412, 414, and 416. Conversely, devices and/or operators in another gaming establishment may communicate with and/or control devices in casino 406.

Some of these servers in computer room 404 may be configured to perform tasks relating to accounting, player loyalty, bonusing/progressives, configuration of gaming machines, etc. A Radius server and/or a DHCP server may also be configured for communication with the gaming network. In various embodiments, sbX™ server 428 and the other servers shown in FIG. 4 include or are in communication with clustered CPUs, redundant storage devices, including backup storage devices, switches, etc. Such storage devices may include a redundant array of independent disks (RAID) array, back-up hard drives and/or tape drives, etc.

In various embodiments, many of these devices (including but not limited to License Manager 430, servers 434, 436, 438, and 440, and main network device 444) are mounted in a single rack with sbX™ server 428. Accordingly, many or all such devices will sometimes be referenced in the aggregate as an "sbX™ server." However, in alternative implementations, one or more of these devices is in communication with sbX™ server 428 and/or other devices of the network but located elsewhere. For example, some of the devices could be mounted in separate racks within computer room 404 or located elsewhere on the network. Moreover, in some implementations large volumes of data may be stored elsewhere, e.g., via a storage area network ("SAN").

Computer room 404 may include one or more operator consoles or other host devices that are configured for communication with other devices within and outside of computer room 404. Such host devices may be provided with software, hardware and/or firmware for implementing functions described herein. However, such host devices need not be located within computer room 404. Wired host devices 442 (which are desktop and laptop computers in this example) and wireless devices 424 (which are PDAs in this example) may be located elsewhere in gaming establishment 406 or at a remote location.

Some embodiments include devices for implementing access control, security and/or other functions relating to the communication between different devices on the network. One or more devices in central system 408 may also be configured to perform, at least in part, tasks specific to embodiments of the present invention. For example, one or more servers 446, storage devices and/or host devices 442 of central system 408 may be configured to implement the functions described in detail elsewhere herein. One or more servers 446, storage devices 448 and/or host devices 442 of central system 408 may maintain player account information.

Some gaming networks 400 provide features for gaming tables that are similar to those provided for gaming machines, including but not limited to bonusing, player loyalty/player tracking, the use of cashless instruments, etc. Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras 450, radio frequency identification devices 452 and 454, etc., may be used to identify and/or track patrons, playing cards, chips, etc. Some of gaming tables 422 may be configured for communication with individual player terminals (not shown), which may be configured to accept bets, present an electronic representation of a dealer, indicate game outcomes, etc.

Moreover, some such automated gaming tables 422 and/or associated player terminals may include, or may be configured for communication with, a device that includes a coin-out meter, a ticket reader, a card reader, a ticket printer, and/or other related features. In some implementations, one such device may provide such functionality to a plurality of automated gaming tables 422 and/or associated player terminals.

Gaming establishment 406 also includes networked kiosks 456. Kiosks 456 may include card readers, ticket readers, printers, a user interface system, one or more displays, etc. Depending on the implementation, kiosks 456 may be used for various purposes, including but not limited to cashing out, prize redemption, redeeming points from a player loyalty program, redeeming "cashless" indicia such as bonus tickets, smart cards, etc.

Kiosks 456 may be configured to read information from, and/or write information to, a portable instrument such as a smart card, a ticket, a card having a magnetic strip, etc. The corresponding gaming devices are preferably configured for communication with such kiosks 456 and vice versa. Accordingly, some such kiosks 456 may include a wireless interface that is configured for communication with mobile gaming devices 424.

In the exemplary embodiment, each bank 420 has a corresponding switch 458. Each switch 458 is configured for communication with one or more devices in computer room 404 via main network device 444, which combines switching and routing functionality in this example. Although various communication protocols may be used, some preferred implementations use the Gaming Standards Association's G2S Message Protocol. Some systems may use a gaming-industry-specific transport layer called CASH™, which offers additional functionality and security.

Gaming establishment 406 may also include an RFID network, implemented in part by RFID switches 460 and multiple RFID readers 452. An RFID network may be used, for example, to track objects such as mobile gaming devices 424, which include RFID tags 454, patrons, chips, player loyalty devices, etc., in the vicinity of gaming establishment 406.

Various alternative network topologies can be used to implement different aspects of the invention and/or to accommodate varying numbers of networked devices. For example, some gaming establishments may include cameras 450 for implementing advanced player tracking, player navigation or other functionality. Gaming establishments with large numbers of gaming machines 418 may require multiple instances of some network devices (e.g., of main network device 444, which combines switching and routing functionality in this example) and/or the inclusion of other network devices not shown in FIG. 4. Some embodiments may include one or more middleware servers disposed between kiosks 456, RFID switches 460 and/or bank switches 458 and one or more devices (e.g., a corresponding server, router or other network device) in computer room 404. Such middleware servers can provide various useful functions, including but not limited to the filtering and/or aggregation of data received from switches, from individual gaming machines and from other devices. Some implementations of the invention include load-balancing methods and devices for otherwise managing network traffic.

Gaming network 400 and its depicted components therein, along with various other components previously depicted may be, in various embodiments, configured to perform functionality according to the methods of the present invention as will be described. Specifically, for example, sbX™ server 428, central system 408, servers 446, main network device 444, storage devices and/or host devices 442 of central system 408 may be configured to implement the functions described in detail, following. The sbX™ server 428, for example, may perform various system-level functions such as facilitating data transfer between data sampled from gaming machine and data processing device for event re-creation at a subsequent time.

Figure 5:
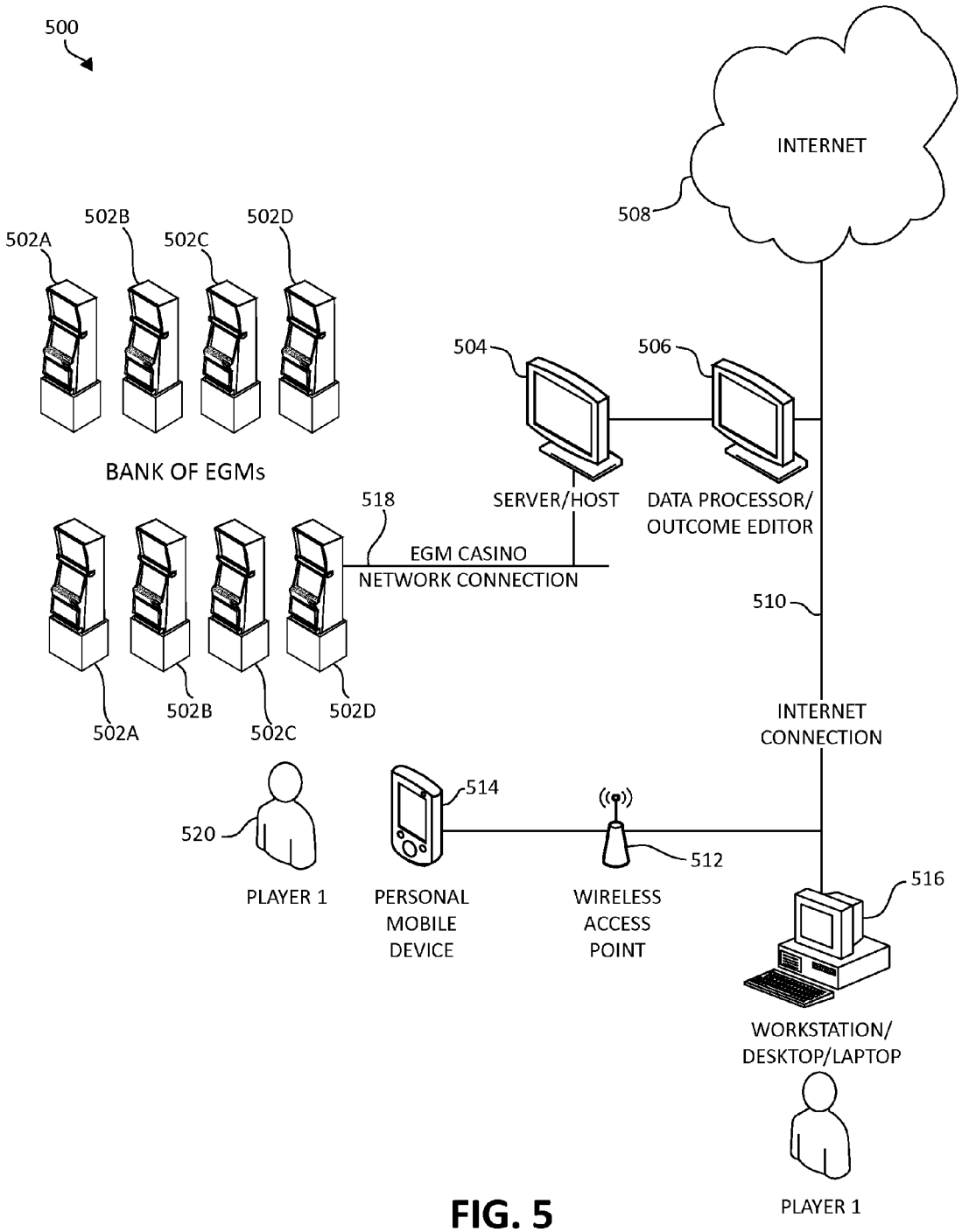
FIG. 5 is a block diagram illustrating an alternative gaming system that contains multiple EGMs, in which aspects of the present invention may be realized.

Turning now to FIG. 5, a simplified block diagram of various components previously depicted in FIG. 4 are shown for purposes of additional clarity and simplification in the context of the illustrated embodiments. FIG. 5 illustrates a gaming system 500 having banks of EGMs 502 (illustrated as 502A-D). The EGMs are in network communication with a server/host 504, such as the aforementioned illustrated sbX™ server 428 (FIG. 4). The server is connected to an external data processor/outcome editor device 506, which is in turn connected to the Internet 508.

Player 520 is able to access data processor 506 over Internet connection 510. Player 520 can, in turn, operate Personal Electronic Devices (PED) and/or other type of mobile devices, here depicted as personal mobile device 514 (e.g., a mobile digital device, digital media extender, a smart phone, an electronic tablet, a player mobile device 'PMD,' a computer, and the like) to access data processor 506 through wireless access point 512. Player 520 may also operate computer 516 (e.g., workstation, desktop, laptop, tablet) to access internet connection 510 and thereby, data processor 506.

Data processor 506 is configured, in one embodiment, to piece sampled data retrieved from server/host 504 in re-creating a game outcome. Specifically, data processor 506 may be adapted with software to virtualize certain aspects of the facsimile event re-creation. In other words, data processor 506 may be configured to process the available data relating to a certain event, and virtualize remaining data relating to the event such that a complete re-creation of the event is generated. Data processor 506 may also function as a server 506, granting access after a verification process to player 520 to view, edit, and distribute a facsimile event re-creation of a game outcome, for example.

Player 520 may utilize an outcome editor on data processor 506, as will be further described, to perform editing functionality on the facsimile event re-creation. For example, the player 520 may choose to retain certain highlights of the outcome, or condense the event into a more manageable and/or viewable length. Player 520 may implement outcome editor 506 to determine recipient(s) to send content relating to the re-creation or other content associated with the gaming environment. As one of ordinary skill in the art will appreciate, and as will be further described, the player 520, in conjunction with software operational on personal mobile device 514 and/or computer 516, may implement various tools to manipulate the facsimile event re-creation in its creation, editing, and/or delivery.

For purposes of explanation of the illustrated embodiments, server/host 504 may be assume to take a role of a system/system device having supervisory control over a game machine (e.g., bank of EGMs 502). In turn, the server 504 may facilitate the delivery of sampled data to the externally (i.e., logically and/or physically) positioned data processor device 506, which in turn processes the sampled data to generate the facsimile event re-creation that is provided to the player 520. This methodology will be further described in the following flow chart diagrams in detail. It will be understood, however, by one of ordinary skill in the art, that the various hardware and software components needed to perform the functionality in the accompanying flow chart diagrams may vary to a great extent depending on a particular application.

As previously mentioned, one mechanism of the illustrated embodiments involves use of I/O overlays to provide information to a player and to obtain, in return, information relating to the event to be later re-created. In one embodiment, when a triggering event occurs such that the player is to be offered a subsequent re-creation of the event, the game system (system device) displays a prompt message to the player on some portion of at least one of the display devices of the gaming machine. Similarly, the game system monitors player inputs on at least one input device, the activation of which will not be interpreted by the game as a game input.

As one of ordinary skill in the art will appreciate, various games position important information to the player in different ways, and including in differing positions of the display screens on the gaming device. As such, it is beneficial to provide customization functionality associated with the I/O overlay mechanism such that the positioning of prompt messages, for example, is done with consideration of the game-specific display positioning. One method this may be accomplished is by pre-storing configuration data on a game-by-game basis such that the gaming system is able to determine the appropriate placement of overlay messages. In any event, the benefits of the I/O overlay functionality allow that, for example, for a new game title, the I/O overlay mechanism only requires updating a configuration file used by the system software, while requiring no changes of the game code itself.

Figure 6:
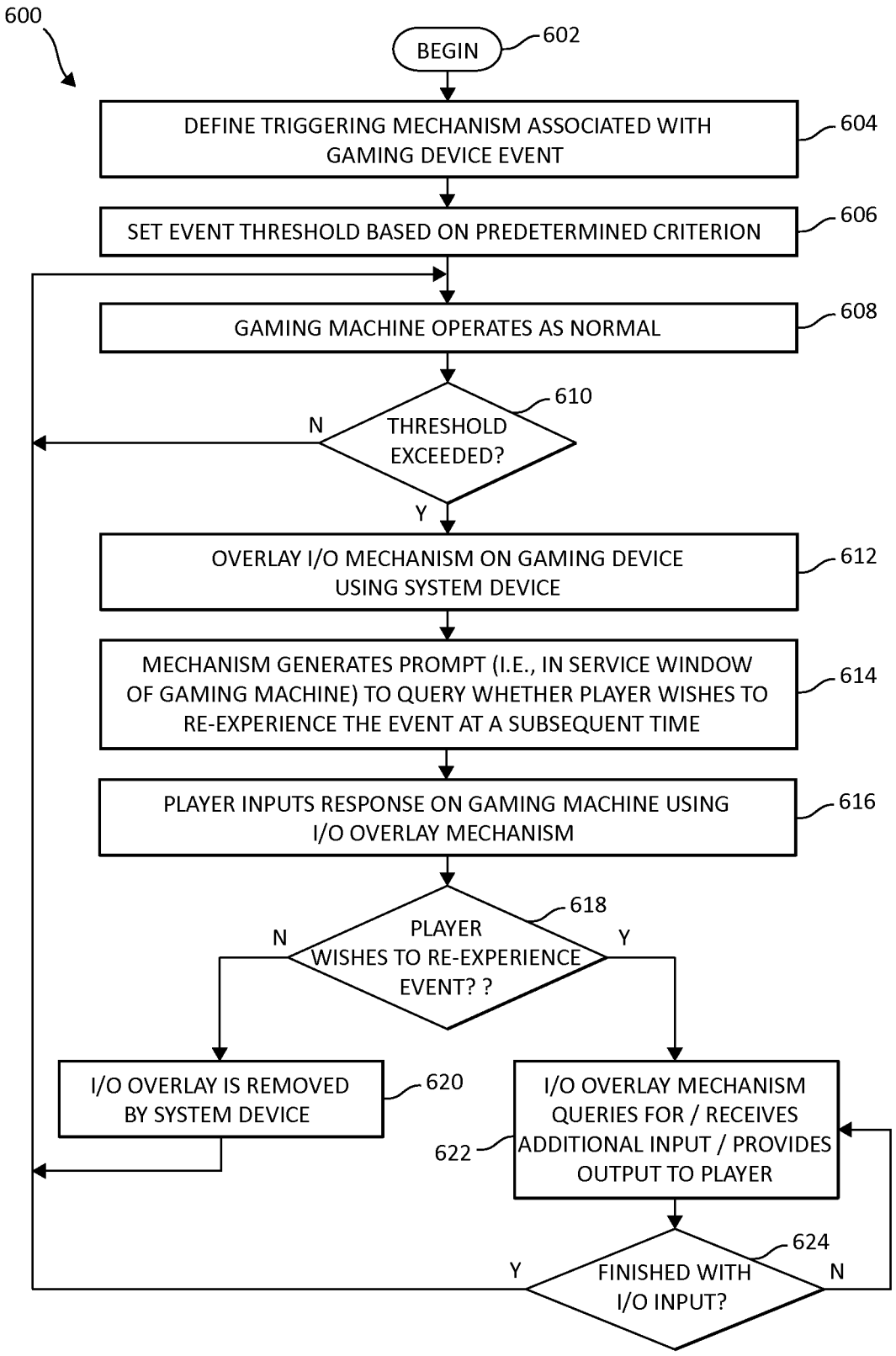
FIG. 6 is a flow chart diagram illustrating an exemplary method for configuring an Input/Output (I/O) overlay for use in gaming devices and systems, for example, those depicted previously, here again in which aspects of the present invention may be realized.

Turning now to FIG. 6, an exemplary method 600 for implementing an I/O overlay mechanism in a gaming environment for facilitating event re-creation is depicted. Method 600 begins (step 602) by defining a triggering mechanism associated with the event in some way (step 604). For example, the threshold may be tied to a monetary amount, such that a player visiting a VIP machine may be tied to a higher monetary threshold than a player visiting a machine in a main floor environment. In addition, and as one of ordinary skill in the art will appreciate, more than a single threshold may be defined that is associated with the event, and/or a threshold may be defined to be associated with a different event. For example, a specific event (e.g., free spin) may warrant consideration of a differing threshold than another event (e.g., big win).

Once the triggering threshold(s) are defined, they may then be set based on a predetermined criterion (step 606). So, for example, a monetary limit for a VIP threshold may be set, etc., etc. The gaming machine then operates as normal (step 608).

Step 610 queries if the threshold has been exceeded. If no, the game continues to operate as normal. When one or more triggering thresholds are exceeded, the system device overlays the I/O mechanism on the gaming device (step 612). In one embodiment, the I/O overlay includes a prompt in the service window of the gaming machine to query whether the player wishes to re-experience the event at a subsequent time (step 614). The player then inputs their response on the gaming machine using the mechanism (step 616).

If the player does not wish to re-experience the event at the subsequent time (step 618), the I/O overlay is removed (step 620), and the method 600 returns to step 608. Returning to step 618, if the player wishes to re-experience the event, the I/O overlay mechanism may query and/or receive additional input from the player, such as whether the player wants to access the event from a link to be sent to their personal email (step 622). This process may continue (steps 622 and 624, which queries if the player is finished with the I/O input), until the input/output process associated with the event to be re-created is concluded. Once this occurs, the method 600 returns to step 608.

Despite the desire for players to preserve events and share with acquaintances, in some circumstances it may be in the gaming establishment's interest to limit the number of occasions in which an event re-creation is offered to a player. For example, in the interest of the gaming establishment's security protocols and for regulatory purposes, it may be advisable to avoid having a player record each game outcome in order, particularly if any of the data to be sampled involved direct video feed. Alternatively, the gaming establishment may, for the sake of increasing the marketing usefulness and perceived value associated with the event re-creation, wish to only associate the functionality with only certain event outcomes.

In addition to the foregoing, another reason gaming establishments may wish to limit the number of outcome re-experiences involves the reduction of the ability of persons or organizations to be able to reverse engineer game elements. For example, the quantity and arrangements of symbols on a video reel strip are generally proprietary in nature. However, a player may, in some circumstances by analyzing a sufficient number of game outcomes, be able to better and better determine the reel strip specifics to gain an unfair advantage in game play.

Finally, in view of the foregoing, a differing reason for supplying re-creation limiting functionality concerns the game state itself. For example, it may be in the best interest of the gaming establishment not to distract a player with re-creation overlay information while the reels are still spinning, or by doing so, potentially telegraphing the win to the player before the win even appeared, thus affecting the anticipatory nature of games and possibly incorrectly calling into question the trustworthiness of the machine. Accordingly, it is beneficial for such mechanisms to incorporate game state information in the consideration of when to offer event re-creation functionality.

The following illustrated mechanisms address these concerns by providing methodologies for the gaming machines to offer re-creation functionality without the need for special calls into and/or interrupts from the game code. Here again, various system data may be used to formulate decisions as to timing and/or whether to trigger the event re-creation functionality in the first place. For example, game state information may be analyzed (e.g., is the main game currently in operation, versus a free spin game offer) to determine appropriateness of event re-creation.

In one embodiment, the offerings of event re-creation may be limited at least to winning outcomes, and specifically, to winning outcomes of a certain size or larger. The gaming system may accomplish this without game-specific code by, for example, evaluating the size of a game win relative to the last wager against a pre-stored award multiplier threshold. In addition, certain customization of various triggering threshold mechanisms previously describe may further limit the offerings of event re-creation functionality.

Consider the following example. The game system (e.g., system device) may take advantage of its ability to access current data to detect a free spins win event without being provided explicit information from the game code itself. This may be accomplished, for example, by monitoring and observing more than a single RNG request per wager, and/or potentially also any time delay between requests. An extra long delay for a given type of working game would be commensurate with a long credits roll-up associated with a big win. As one of ordinary skill in the art will appreciate, the more system data which is available to be considered in this thresholding, the more refined the control could be.

Figure 7A:
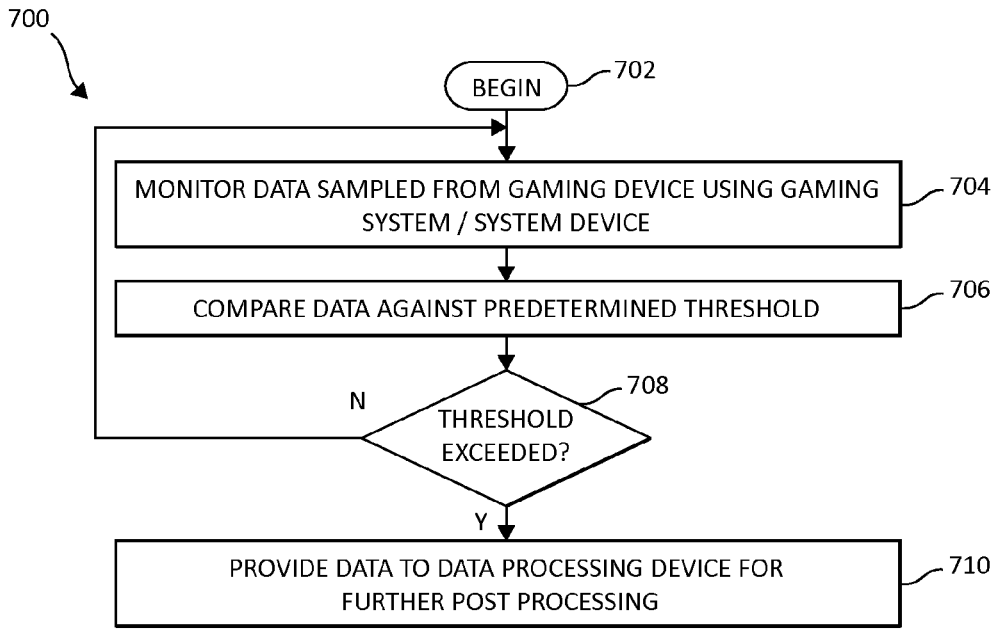
FIG. 7A is a flow chart diagram illustrating an exemplary method for operating a threshold triggering mechanism, in which aspects of the present invention may be realized.
Figure 7B:
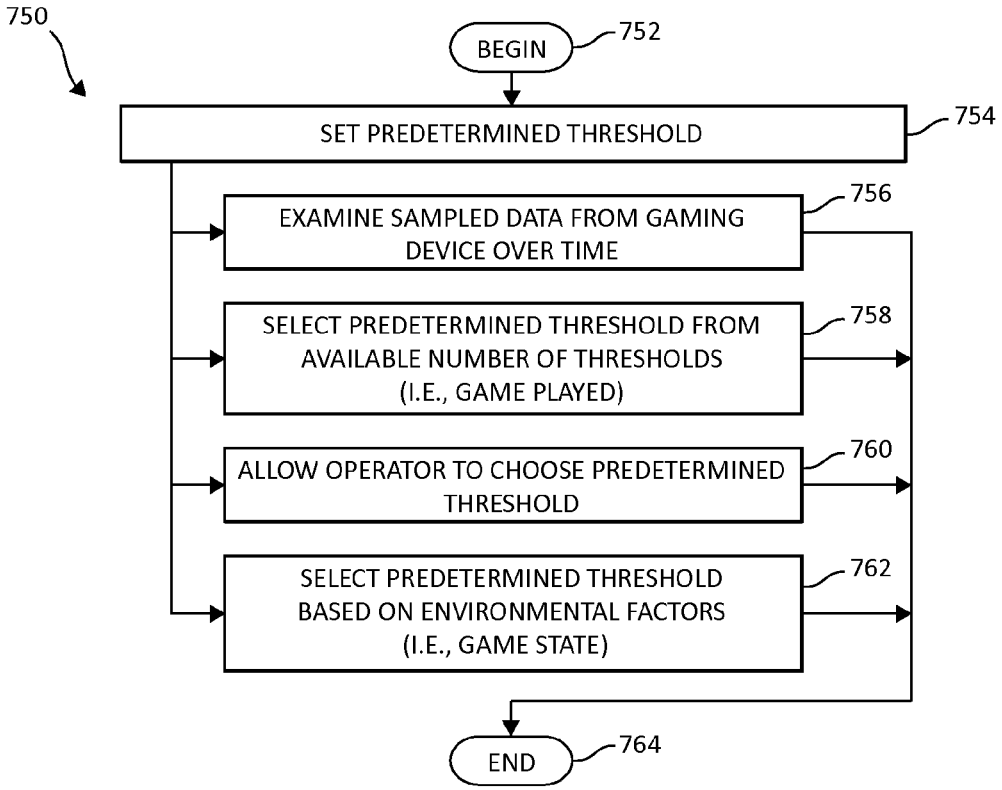
FIG. 7B is a flow chart diagram illustrating exemplary mechanisms for setting and selecting the triggering mechanism previously depicted in FIG. 7A.

Turning now to FIGS. 7A and 7B, various flow chart diagrams 700 and 750 illustrate exemplary mechanisms for performing this aforementioned functionality. Method 700 illustrate exemplary dynamic thresholding based on available data, while method 750 illustrates various types of thresholding based on several available factors. Turning first to method 700, method 700 begins (step 702) by monitoring data sampled from the gaming device using the gaming system/system device (step 704). Step 704 refers to, as previously described, the act of gathering readily available data to the extent warranted or desired, to perform various thresholding tasking and thereby determine, for example, if the re-creation functionality should be offered at a particular time in gameplay operation.

Returning to method 700, in step 706, the gathered data is compared against one or more predetermined thresholds (step 706). This comparison can include the previously mentioned comparisons of evaluating sizes of game wins relative to a last wager against a pre-stored award multiplier threshold. As one of ordinary skill in the art will appreciate, additional thresholding mechanisms are contemplated and may be incorporated in this step. When the threshold is exceeded (step 708), at least a portion of the data may be provided to a data processing device for further post processing in order to re-create the event outcome (step 710). Otherwise, returning to step 708, the method 700 returns to step 704 as previously described.

Method 750 begins (step 752) with the setting of a predetermined threshold (step 754). Following, the system device then may perform any one of the following: The system may examine sampled data from the gaming device over time (step 756). The system device may select one or more predetermined thresholds from an available number of thresholds (step 758). For example, differing thresholds may be set according to the game currently being played. The system may allow an operator to choose a predetermined threshold (step 760), such as limiting offerings of event re-creation to a certain system time, or limiting an arbitrary number of event re-creation to satisfy business or other needs. Finally, the system device may select one or more predetermined thresholds based on a number of additional factors, such as the current game state information (step 762). The method 750 then ends (step 764).

As mentioned previously, game outcomes may vary to a large degree depending on the game being played, game status, progressive values in play, and other factors. In view of these differences, it is beneficial for the gaming environment to accommodate these varying outcomes. Accordingly, several of the illustrated embodiments of the present invention herein provide mechanisms for addressing these situations in the context of generation, editing and delivery of re-created content to the player.

Consider the following example. Free spin bonus rounds may present a challenge to a system for providing event re-creation. In certain free spins cases having a large number of free spins, there may only be one or two significant spins worth sharing in what would perhaps be a rather long and boring session. In other situations, when a relatively few number of free spins occur, a player may wish to re-create the entire experience.

A number of possible solutions maybe implemented to address these challenges, as will be further illustrated. In one embodiment, for example, a "highlights reel" may be generated by the data processing device. The data processing device may be configured to evaluate the free spins round and generate a facsimile event re-creation that only includes select portions of the entire bonus based on certain rules (e.g., highest win, wins over a certain size, bonus retriggers, accumulator change events, and the like). As one of ordinary skill in the art will appreciate, the data processing device may also examine other specified scenarios to generate similar highlights.

In another embodiment, the player may be given the ability to implement player-controlled rules for editing and other aspects of the facsimile event re-creation process.

In a further embodiment, an "outcome editor" as will be further described may be configured as a complete editing engine/interface with the player that allows the player to select which aspects (here again, e.g., free spins) to include and which aspects not to include, thereby making the selection and other editing processes fully manual. In addition, the data processing device may then perform the follow up editing tasks (e.g., automated splicing, fades, graphics, sound and other characteristics) necessary to create an abridged experience that is satisfactory to the player.

In a further embodiment, irrespective of how one or more alternate abridged re-creation experiences are generated, the viewer (player or acquaintance) may be allowed to select between full version and one or more abridged versions that are made available for viewing and distribution. In the context of the free spins rounds scenario, the player or other viewer may be allowed to view, edit, or otherwise distribute a complete bonus version and/or one or more abridged bonus versions.

In still further embodiments, the player may be given the ability to make their own determination as to which version or versions will be shared and/or otherwise distributed.

In further embodiments, various hardware and software elements may be made responsible for determining existing resource constraints, and thereby matching event re-creation content characteristics to the existing resource constraints. For example, a player may be accessing the data processing device/outcome editor through the personal mobile device 514 (FIG. 5). As previously explained, the player may use the personal mobile device 514 to view and/or perform generation, version selection, editing functionality and other tasks. In one embodiment, the outcome editor may be configured to determine the accessing device's characteristics and thereby tailor the presentation, ability to edit, delivery, and other aspects of the re-creation experience to the device being used. As a result, the data processing device/outcome editor may serve less bandwidth intensive content to portable computing devices than a host device that is determined to have more storage or processing capability such as a desktop or workstation.

Figure 8A:
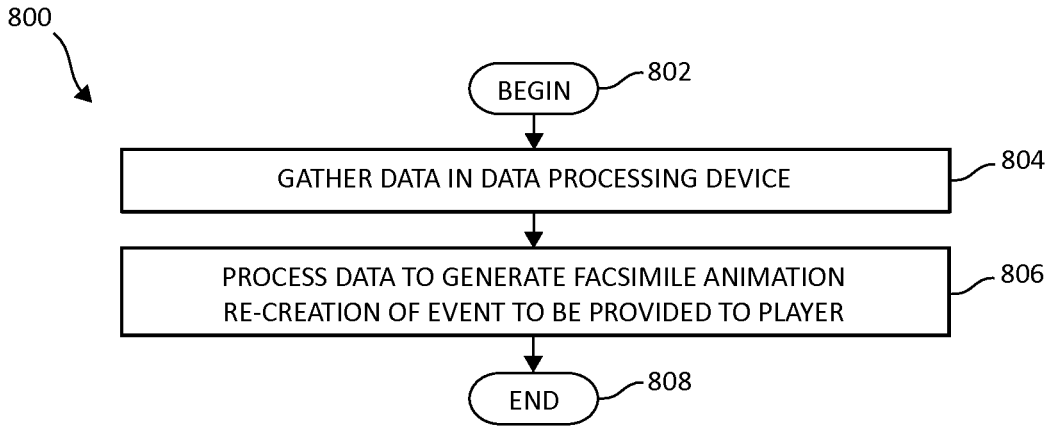
FIG. 8A is a flow chart diagram illustrating an exemplary method for re-creating a facsimile animation of an event (e.g., win event) previously experienced on a gaming machine.

Turning now to FIG. 8A, following, an exemplary method 800 for facilitating event re-creation to a player is shown, in view of the foregoing context. Method 800 begins (step 802) with the gathering of data in the data processing device (step 804). Here again, the data may be collected, transferred, or otherwise provided to the data processing device by use of a server device that has supervisory hierarchical control over the individual gaming machines in the gaming environment. The data is sampled by such system devices and then provided to the data processing device for post-processing as previously described.

In a following step, the data provided to the data processing device is processed to, among other tasks, generate a facsimile animation re-creation of the event, which is then provided to the player (step 806). The content of the facsimile animation re-creation may vary according to the particular application. Moreover, the manipulation of the content, such as editing tasks and delivery functionality may be made controllable by the player in a setting subsequent to the event taking place in the gaming environment. The method 800 then ends (step 808).

Figure 8B:
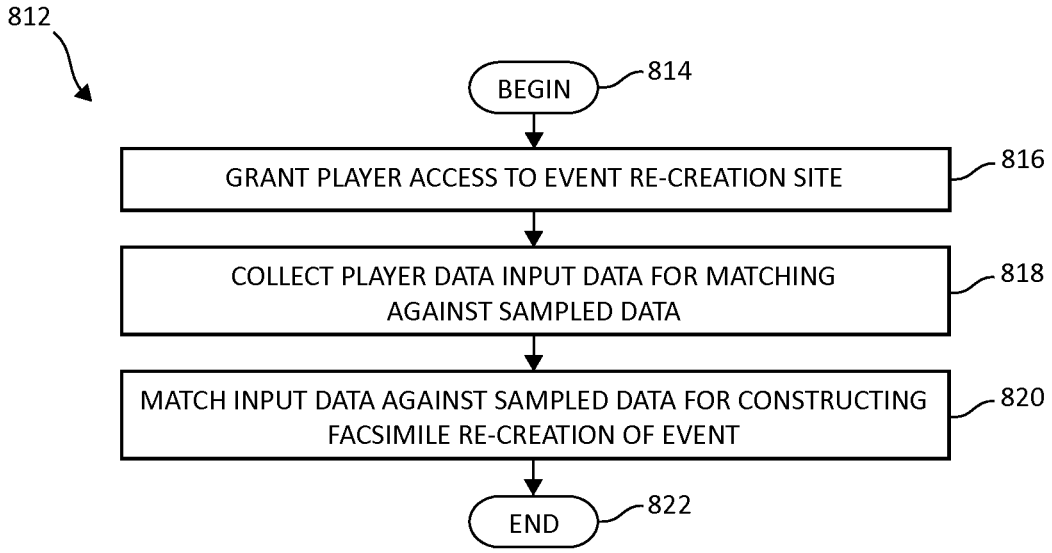
FIG. 8B is a flow chart diagram illustrating an additional exemplary method for re-creating the facsimile animation previously mentioned in FIG. 8A.

FIG. 8B, following, illustrates an additional exemplary method 812 for facilitating event re-creation to a player, here again in view of the foregoing context. Method 812 begins (step 814) by granting player access to the event re-creation site (step 816). The site may be hosted by the data processing device/outcome editor itself, or may be on another location remote from the data processing device. In any event, preferably the data processing functionality and subsequent access and manipulation by a player is located either logically and/or physically remotely from the gaming machines themselves so as not to require additional resources or the encumbrance of existing resources as previously described.

Method 812 continues in step 818 following player access by collecting player data input(s) for matching against sampled data, among other functions. The player data input may include player preferences, rules, information (e.g., player and/or acquaintance contact information), and other data that is provided by the player to the data processing environment. In a final step, the data input(s) supplied by the player are used in part to construct the facsimile event re-creation (step 820). In other words, the data processing environment may utilize the sampled data provided by the gaming system device or devices, and query the player for any missing information in order to reconstruct an accurate and/or complete account of the event. The data, such as the aforementioned player preferences, may be stored by the system. For example, in one embodiment, various display preferences may be recalled in future sequences whereby the player display preferences are automatically applied to all future outcomes. One of ordinary skill in the art will appreciate that the various data may be used in differing purposes according to a particular application or implementation. Step 820 also contemplates the use of the player's inputted data in other ways relative to the generation, editing, delivery, or other functionality associated with the event re-creation.

Figure 8C:
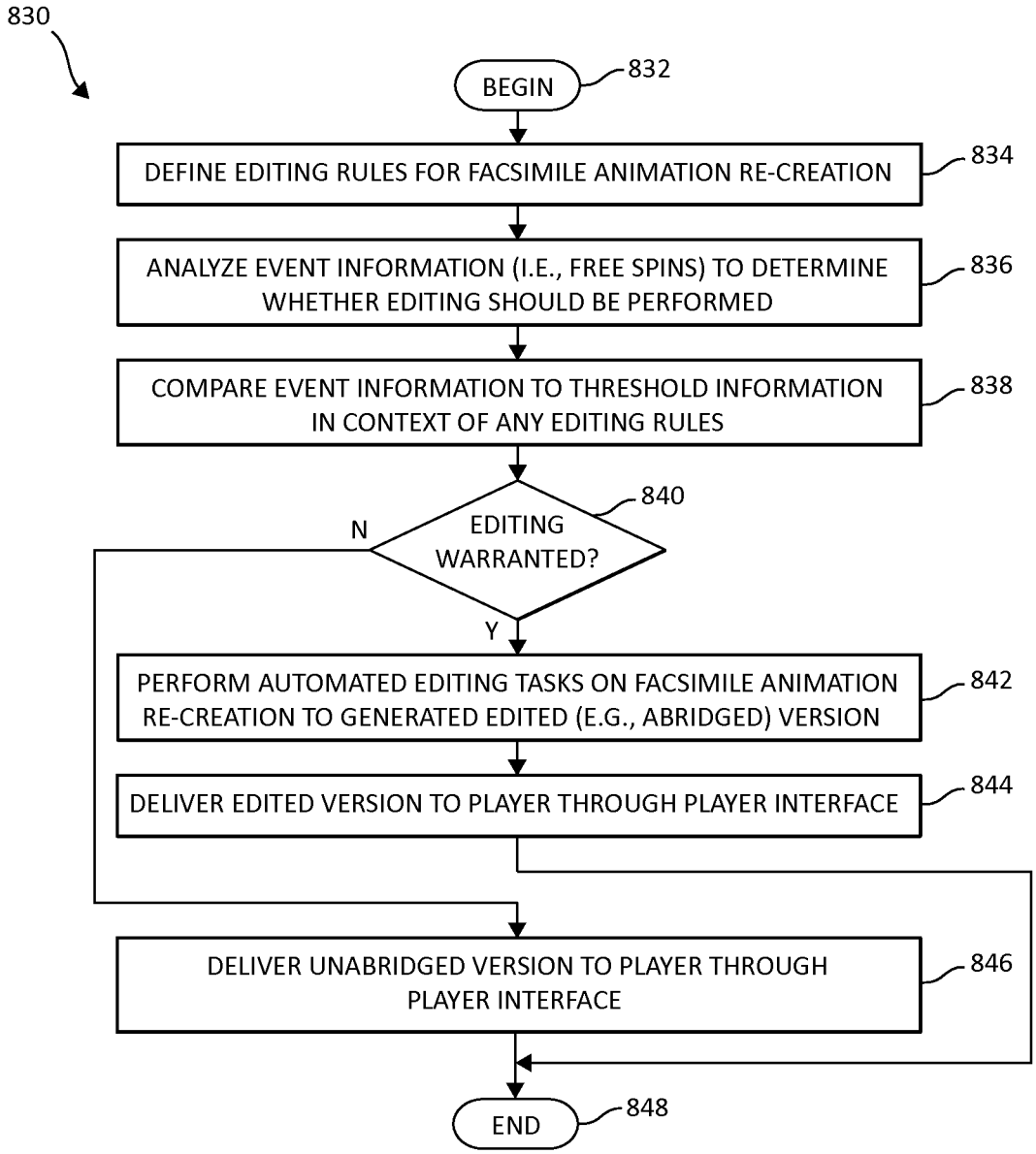
FIG. 8C is a flow chart diagram illustrating an exemplary method for configuration, editing, and similar tasking on a facsimile event re-creation.

Turning now to FIG. 8C, following, an exemplary method 830 is depicted for facilitating event re-creation to a player. Method 830 provides additional functionality that may be offered by the data processing environment in the generation and delivery of re-created event content. Method 830 begins (step 832) with the definition of editing rules for the facsimile event re-creation. These editing rules may be defined by the data processing device itself, an operator, or provided by a player or other user. Continuing to step 836, the data processing device analyzes event information (i.e., event type or game state information) to determine whether editing should be performed. This analysis may include, for example, determining if the event concerned free spins awards versus other game outcomes. A variety of analysis of game information is contemplated in step 836.

Following such analysis, the event information is compared to pre-stored threshold information in the context of any editing rules that were previously defined (step 838). For example, the operator may have predefined a rule to automatically condense an event having a certain number of free spins outcomes or above to a more manageable, abridged event re-creation.

Continuing with method 830, if editing is warranted in the context of these rules (step 840), the method 830 turns to step 842, where automated editing tasks are performed on the facsimile animation re-creation to generate edited (e.g., abridged) content. As a subsequent step, the edited content is delivered to the player on whatever device the player is accessing the data processing environment through a player interface (e.g., GUI screen, touch screen, etc.). Returning to step 840, if editing is determined, under the previously described analysis, not to be warranted, the method 830 moves to step 846, where an unabridged version of the re-created event is delivered to the player through the player interface. In either case, the method 830 then ends (step 848).

Figure 8D:
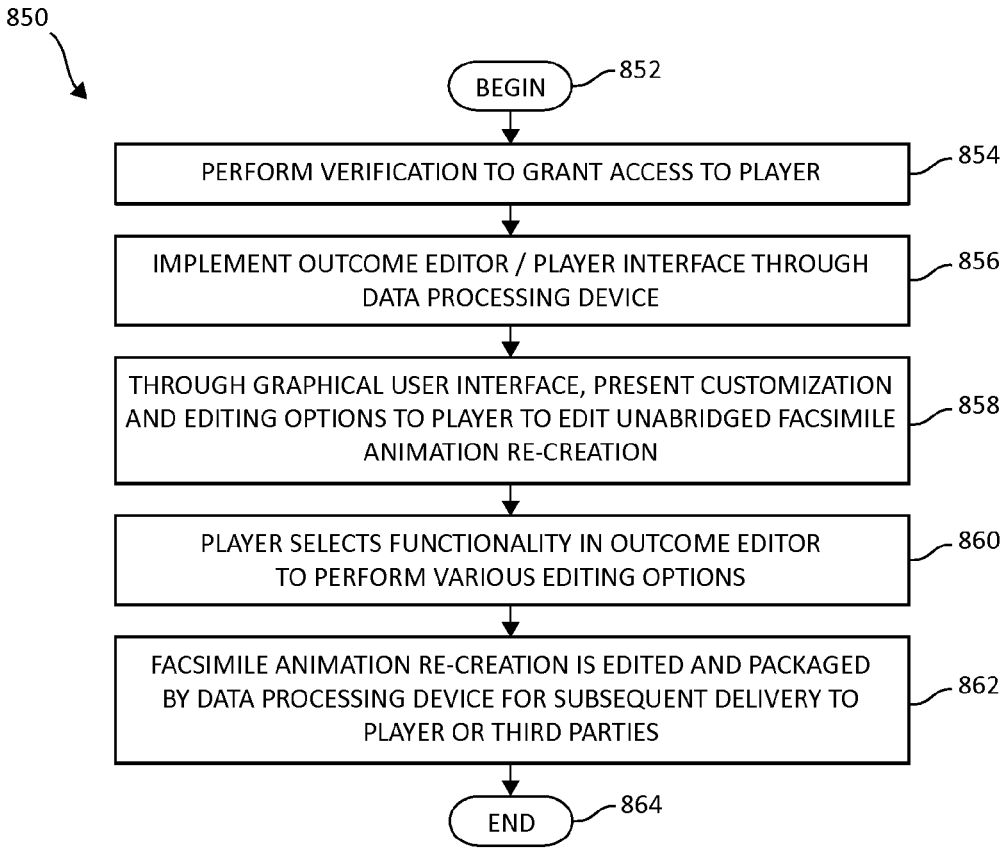
FIG. 8D is a flow chart diagram illustrating an exemplary method for facilitating delivery, interaction, editing, and the like of the facsimile event re-creation by a player.

Turning now to FIG. 8D, an exemplary method 850 is depicted for again facilitating event re-creation to the player, here using the outcome editor functionality of the data processing system. Method 850 begins (step 852) by again performing verification steps to grant access to the player to the data processing device (step 854). Once access is granted, an outcome editor/player interface is implemented through the data processing device (step 856). As one of ordinary skill in the art will appreciate, the outcome editor and/or player interface may be implemented by use of varying processor, storage, network and other interconnected devices which are physically located together or separately in various locations. For purposes of simplification, the term "data processing device" is used to make reference to the possibility of these various components, all dedicated to providing specific functionality relating to generating, manipulating and delivering event re-creation content.

Returning to method 850, step 856 moves to step 858, which provides, through the a Graphical User Interface (GUI), for example, presentation of customization and editing options to the player to edit the unabridged facsimile animation re-creation. The player is then free to select the various functionality supplied through the GUI to perform various editing options (step 860). Those editing options may include tasks previously described, such as cutting, pasting, rearranging, adding or removing sections of content, applying color correction, filters and other enhancements, creating transitions such as fades, adding music or other soundtrack or background information, adding or changing graphics and other effects, and other similar tasks known to one of ordinary skill in the art. In this manner, the player is able to perform such functionality as removing unwanted footage, choosing the best footage, creating a flow or theme, adding effects, graphics, music, etc., altering the style pace or mood of the event, and/or giving the event a particular "angle."

By allowing the player the customization functionality previously described, gaming establishes serve to increase their visibility and enhance the overall player experience, while reinforcing positive experiences in the gaming environment, providing greater entertainment to the player, and so on. The gaming establishment is then seen to provide more add value to the player's overall gaming experience through use of such functionality.

Returning again to Method 850, the method moves to step 862, which completes the editing processing functionality and then packages the content for subsequent delivery to the player or to third parties (step 862). The method 850 then ends (step 864).

As previously mentioned, the general notion of win thresholding, especially through selection and encouragement of high value, low frequency wins, may be used as a mechanism for reducing bandwidth and otherwise conserving limited hardware, storage, network, and other resources. Furthermore, a given EGM, and any hardware located between it and the Internet, may rely upon memory caching to supply data according to bandwidth usage requirements and needs. In other words, the gaming machine, system device, and other hardware resources may implement memory caching to limit the amount of data sent over the network until additional bandwidth and/or other resource availability allows delivery of the remainder of the data.

A more sophisticated system embodiment may be configured to adjust triggering award thresholds based on bandwidth availability and expected usage. For example, during weekends or conventions when play is greatly increased, the thresholds may be raised to reduce the number of occurrences when the event re-creation functionality is offered to the player. Alternatively/additionally, the network system may monitor if/when more content is being generated than can be delivered, and adjust thresholds on a dynamic basis.

As previously illustrated, the mechanisms of the present invention contemplate the use of system data to re-create facsimile animations of the outcomes instead of live recordings. Accordingly, when the gaming system registers a user request for event re-creation to occur, the system merely needs to convey a relatively small amount of data, such as player identification (ID) (e.g., casino club card ID, IGT® Federated ID, or email address), wager amount, win amount, game ID (e.g., game title and/or specific math model), and game outcome information.

In the case where event re-creation functionality is desired to be added to existing infrastructure without modification of game code, the game outcome information could be the RNG seed and/or RNG output used for the corresponding outcome. In the event of a free spins bonus, data for each outcome may be sampled. On the other hand, for free spins bonuses that use consecutive RNG outputs without certain characteristics of randomization, or uses some form of outcome scripting, then only bonus initialization data would be necessary. In each case, only a minimal amount of data is sampled to be provided to the data processing device needed to fully recreate the event, as one of ordinary skill the art will appreciate.

Figure 8E:
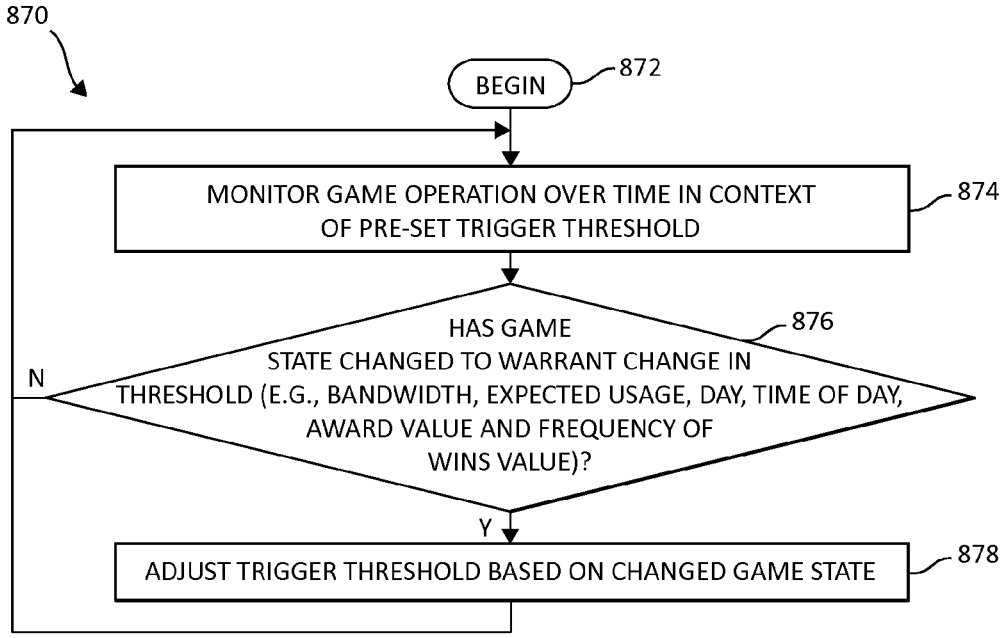
FIG. 8E is a flow chart diagram illustrating an exemplary method for dynamically adjusting the triggering threshold(s) previously described.

Turning now to FIG. 8E, following, an exemplary method 870 for facilitating event thresholding in the foregoing context is illustrated. Method 870 begins (step 872) with the monitoring of game activity over time in the context of one or more pre-set trigger thresholds (step 874). Step 876 then queries whether the game state or other factors have changed in the context of the game play to warrant a change in the thresholding, as previously described. These factors or state changes may include a game title change, time of day, usage, expected usage, bandwidth or other resource use, award value, and frequency of wins value, for example. If the factors warrant the trigger thresholding to be adjusted, step 878, following adjusts the threshold higher or lower to reflect the changing factors associated with the gaming environment. Method 870 then returns to step 874 to continue monitoring game play and other factors in the gaming environment.

Players and gaming establishments may benefit alike if players are allowed to customize construction, presentation, and delivery of event re-creation content. Gaming establishments may promote such customization without encumbering existing gaming resources by making this functionality available in an "off-EGM" basis, here again as previously described.

In view of the foregoing, some of the illustrated embodiments of the present invention provide mechanisms for players to better control the content and distribution of their facsimile animation re-creations. These embodiments include the following. First, the player may be given an ability to select which recipients on which channels (e.g., social networking channels, email, other distribution channels) are to automatically receive event posts that come from the gaming establishment. Secondly, the player may be given the ability to set general rules as to what kinds of events to forward. These rules may include a rule that only forwards events having a win amount greater than $100, an award multiplier greater than 20×, a game type (e.g., only video poker outcomes), and the like.

Third, the illustrated embodiments may provide other services to the player that are customizable on a player-by-player basis. Fourth, the designated recipients of this event re-creation content may be given the option to opt-out of future posts of content. Fifth, the player may be able to control recipient selection via exclusion or other specified methodologies (e.g., specify the group to exclude versus a larger group to include). Finally, any of the functionality described herein may also be alternately controllable by the gaming establishment themselves on behalf of specific players, and/or players in general.

In addition to the foregoing, any event experienced by the player in the gaming establishment or in some way relating to the establishment may be configured to be communicated to the player on a subsequent basis and/or to third parties. Consider the following example. In a certain fantasy game, a player may "level up" or reach some additional level of achievement within the game. As a result, the player may reach an additional status level or be awarded points or other incentives. The player may wish to share this achievement with acquaintances and other third parties. The mechanisms of the illustrated embodiments contemplate the construction, generation, editing, and delivery of any such achievements or other events that may occur in the gaming establishment or otherwise be associated with a particular game.

Figure 9A:
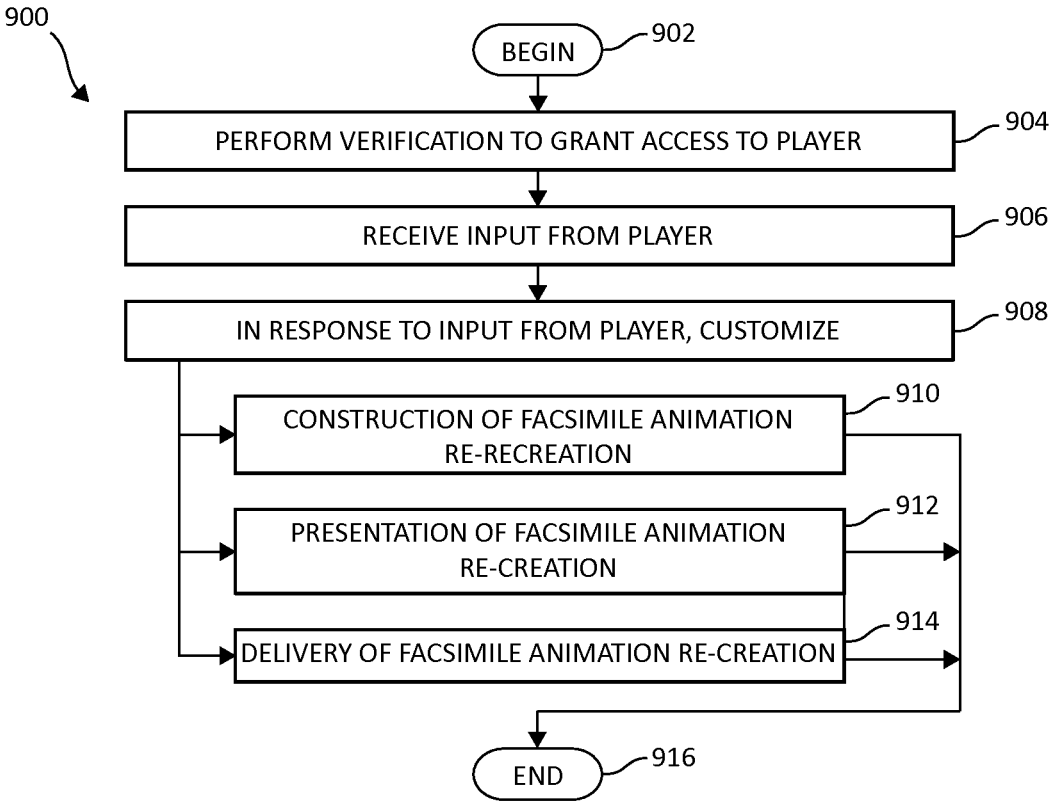
FIG. 9A is a flow chart diagram illustrating an exemplary method for gathering input from a player and/or operator in construction, presentation, and/or delivery of the facsimile animation re-creation previously mentioned.
Figure 9B:
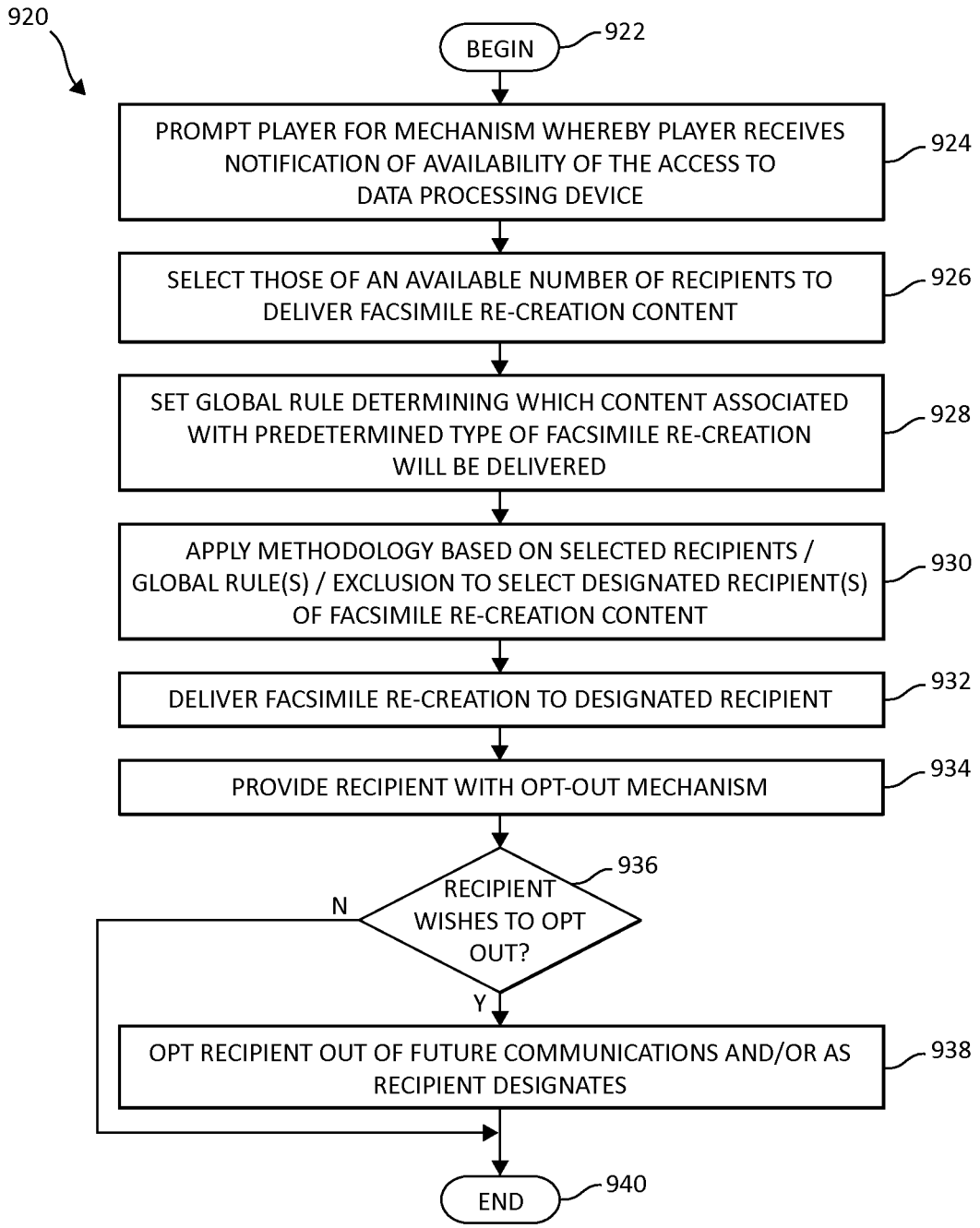
FIG. 9B is a flow chart diagram illustrating an exemplary method for application of rule-based mechanisms and other factors for delivery of facsimile re-creation content.

To illustrate the mechanisms of providing such flexibility to the player, operator, and others, FIGS. 9A and 9B illustrate exemplary methods for providing customization functionality as previously described. FIG. 9A shows method 900 for facilitating event re-creation functionality, which begins (step 902) by performing verification to grant access to the player (step 904). The method 902 moves to step 906, where input is received from the player towards the customization functions. In response to the player input (step 908), method 900 may (1) customize the construction of the facsimile animation re-creation (step 910); (2) customize the presentation of the facsimile animation re-creation (step 912), and/or customize the delivery of the facsimile animation re-creation (step 914). The method 900 then ends (step 916).

FIG. 9B shows method 922 for facilitating event re-creation functionality, which begins (step 924) by prompting the player for a mechanism whereby the player receives notification of the availability of the access to the data processing device (step 926). This may, in one embodiment, be an email message that is sent to the player's email account. The gaming establishment, operator, player, administrator, and the like then selects those of an available number of recipients to deliver the facsimile re-creation content (step 926), and sets one or more global rules determining which content associated with the predetermined type of facsimile re-creation will be delivered (step 928).

In following step 930, a methodology based on selected recipients/global rules/exclusion/other factors is applied to select designated recipient(s) of the facsimile re-creation content. The facsimile event re-creation content is delivered to the designated recipient(s) (step 932). The recipient(s) are provided with an opt-out and/or opt-in mechanism for delivery of this and future content (step 934). In step 936, if the recipient wishes to opt out, the method 922 moves to step 938 as the recipient is opted out of future communication and/or as recipient designates. Otherwise, the method 920 ends (step 940).

Turning now to FIGS. 10-16, following, various exemplary illustrations of sample display images that are presented to a player, using the various embodiments of the present invention, are depicted. It should be noted that while these exemplary display screens illustrate one exemplary embodiment, one of ordinary skill in the art will appreciate that the manner in which information is collected from and/or provided to the player will vary to a great degree depending on a particular situation.

Figure 10:
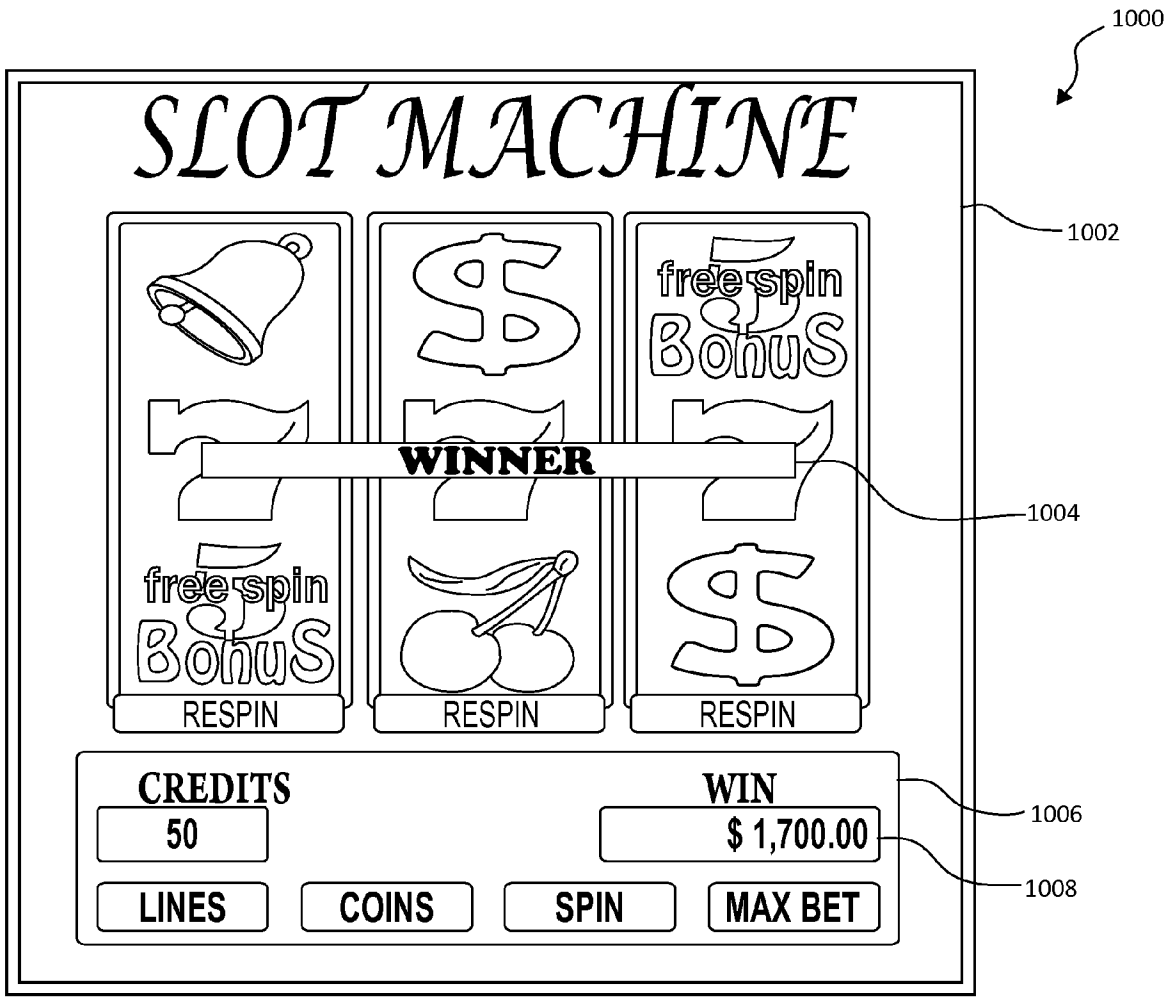
FIG. 10 is an exemplary display on a gaming device indicating a win event.
Figure 11:
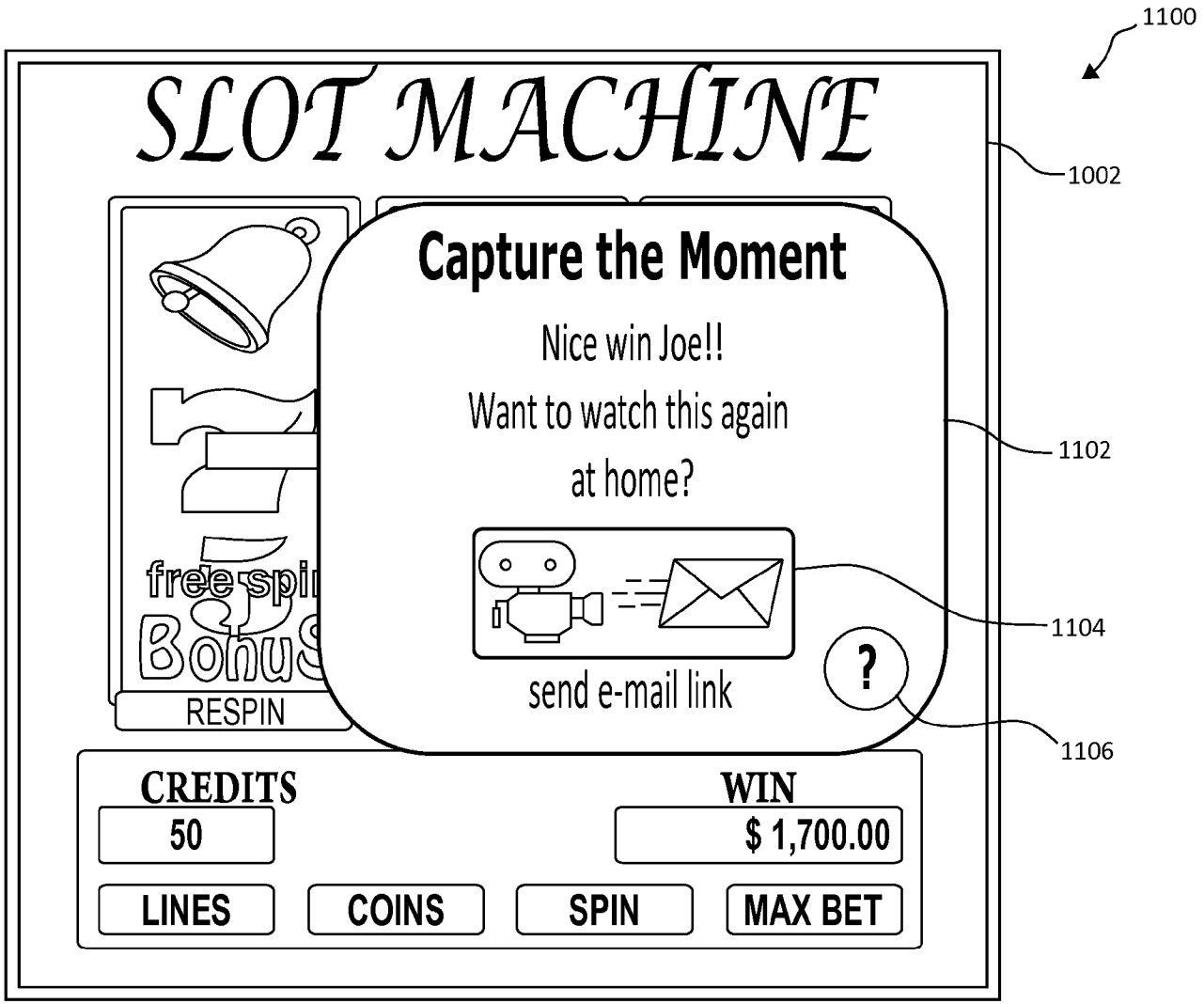
FIG. 11 is the exemplary display previously depicted in FIG. 10, here showing an exemplary I/O overlay that is querying the player for input.

Turning first to FIG. 10, an exemplary display 1000 is shown. Display 1000 represents typical display images that may be shown to a player during game play. Display 1000 includes window 1002, which indicates that this is the game "Slot Machine" and displays virtual reels as shown. Window 1006 includes additional display information to the user, such as the amount of available credits, lines, coins, spin, and max bet virtual buttons as shown. Finally, in the win window 1008, the winning game outcome of $1700.00 is shown, along with "Winner" banner 1004. Accordingly, display 1000 indicates that the player is enjoying a large winning game outcome. As one of ordinary skill in the art will appreciate, display 1000 conveys the typical information to the player that would be shown in such a winning outcome. In addition, for purposes of convenience and simplicity, any additional information (e.g., service window information) that may be displayed on accompanying displays to display 1000 is not shown in the instant Figure.

In view of the illustrated embodiments, it may be appreciated that a number of internal mechanisms may have taken place, either previous to and/or subsequent to the display of the winning game outcome to the user. For example, the mechanisms of the present invention that contemplate data analysis, threshold triggering, data comparison, and the like are taking place, have taken place, or will soon take place commensurate with the information displayed on display 1000.

The mechanisms of the present invention, for example, may implement the data comparison and other data analysis previously described to determined that the appropriate trigger threshold(s) have been exceeded. As a result, a determination is then made to overlay the I/O window shown in FIG. 11 as display 1100, following. As shown, overlay 1102 includes information communicating to the player that the positive game outcome they have just experienced has been determined to be eligible for event re-creation at a subsequent time. Overlay 1102 includes personal information to the player, for example that may be reflective of information retrieved from the player's casino club card, for example. In other words, the message and other information provided to the player through the I/O overlay 1102 may be configured to be personalized to the player in a variety of ways. Here again, in addition, the placement of the I/O overlay 1102 may vary depending on the requirements determined by the system device as previously described. As a result, the placement of the I/O overlay may appear in a service window, or otherwise would not obscure other important game information that would be visible to the player.

I/O overlay 1102 includes icon 1104 which is adapted to receive player input, and question icon 1106, also adapted to be pressed by the user if the user has questions about the information presented to her. I/O overlay 1102 may be configured with a "timeout" feature, such that if the user does not press the icon 1104 within a certain time, the I/O overlay times out, and is removed from the player's view. Other mechanisms for management of the player's responses are contemplated and will be appreciated by one of ordinary skill in the art.

Figure 12:
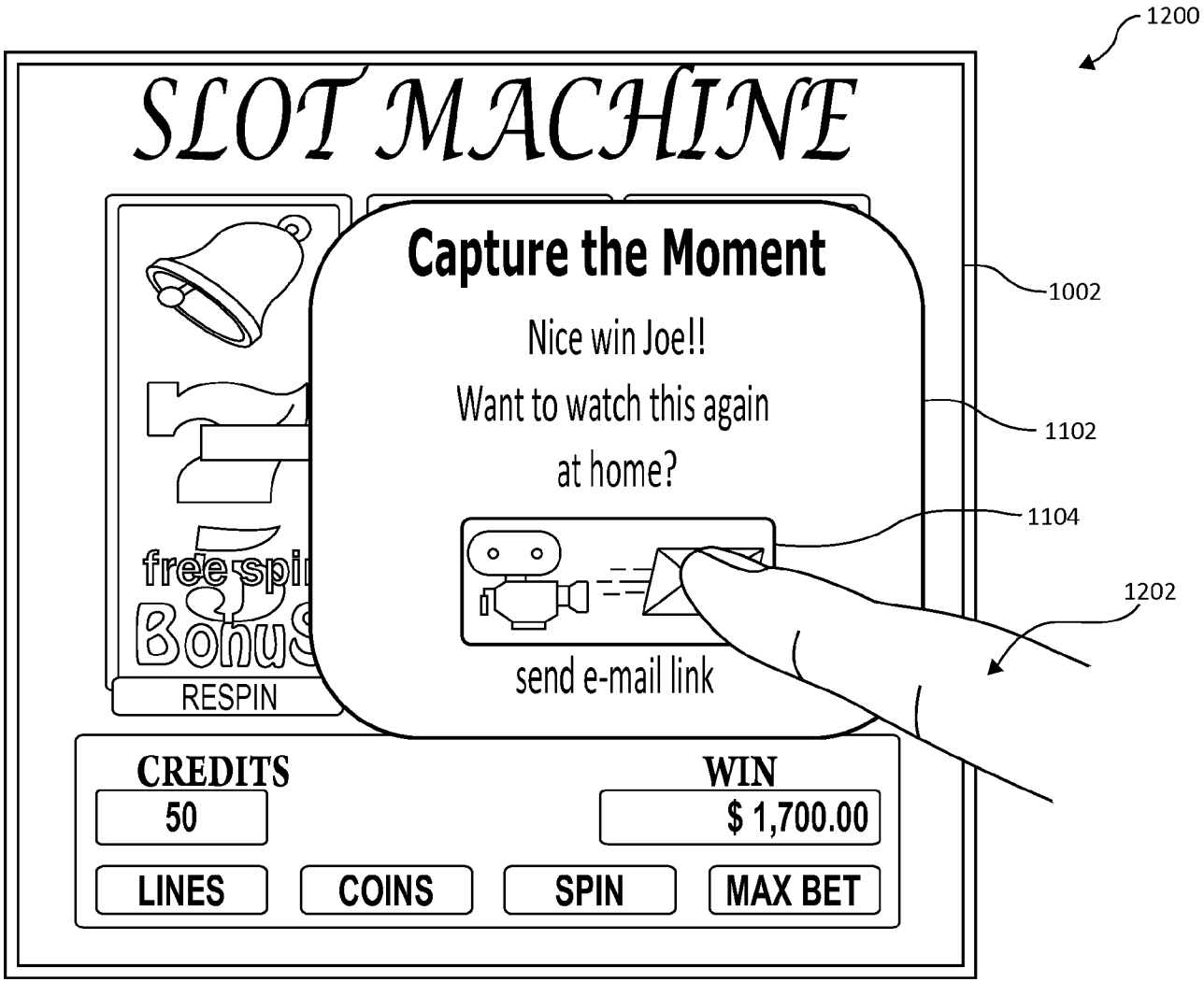
FIG. 12 is an additional depiction of the exemplary display previously depicted in FIG. 10, here showing the player providing input.
Figure 13:
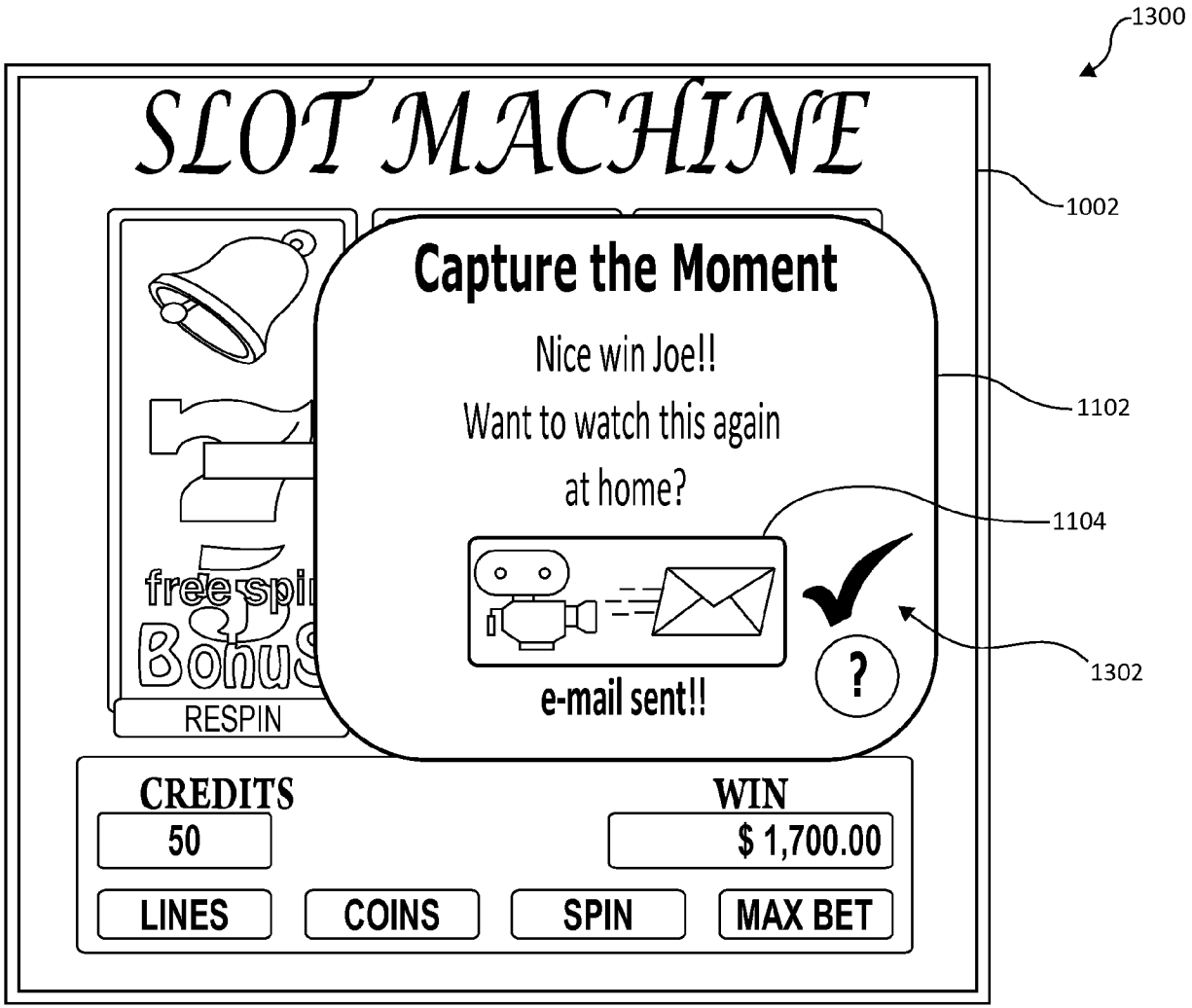
FIG. 13 is an additional depiction of the exemplary display previously depicted in FIG. 10, here showing a confirmation of the input received.

Turning to FIG. 12, the user's finger 1202 is seen pressing the icon 1104 to illustrate that the player wishes to experience the event again at a subsequent time. Accordingly the event itself is designated to the system device, and the data relating to the event that was sampled from the gaming machine is preserved, and provided to the data processing device for later facsimile event re-creation. The I/O overlay communicates that this selection/designation process is complete in FIG. 13 on display 1300, using check icon 1302 as shown. Here the player is shown the check icon to indicate that the event is "preserved" for future viewing, and a link has been provided to his email address. It should be noted that while the illustrated embodiment depicts an email link used as a communication channel to the player, other communication mechanisms such as texting, instant messaging, recorded messaging and the like are also contemplated. The mechanisms of the illustrated embodiments contemplate presenting the depicted information to the user in some manner such that the user is able to use some form of communication channel to access the data processing device for event re-creation functionality at a subsequent time.

Figure 14:
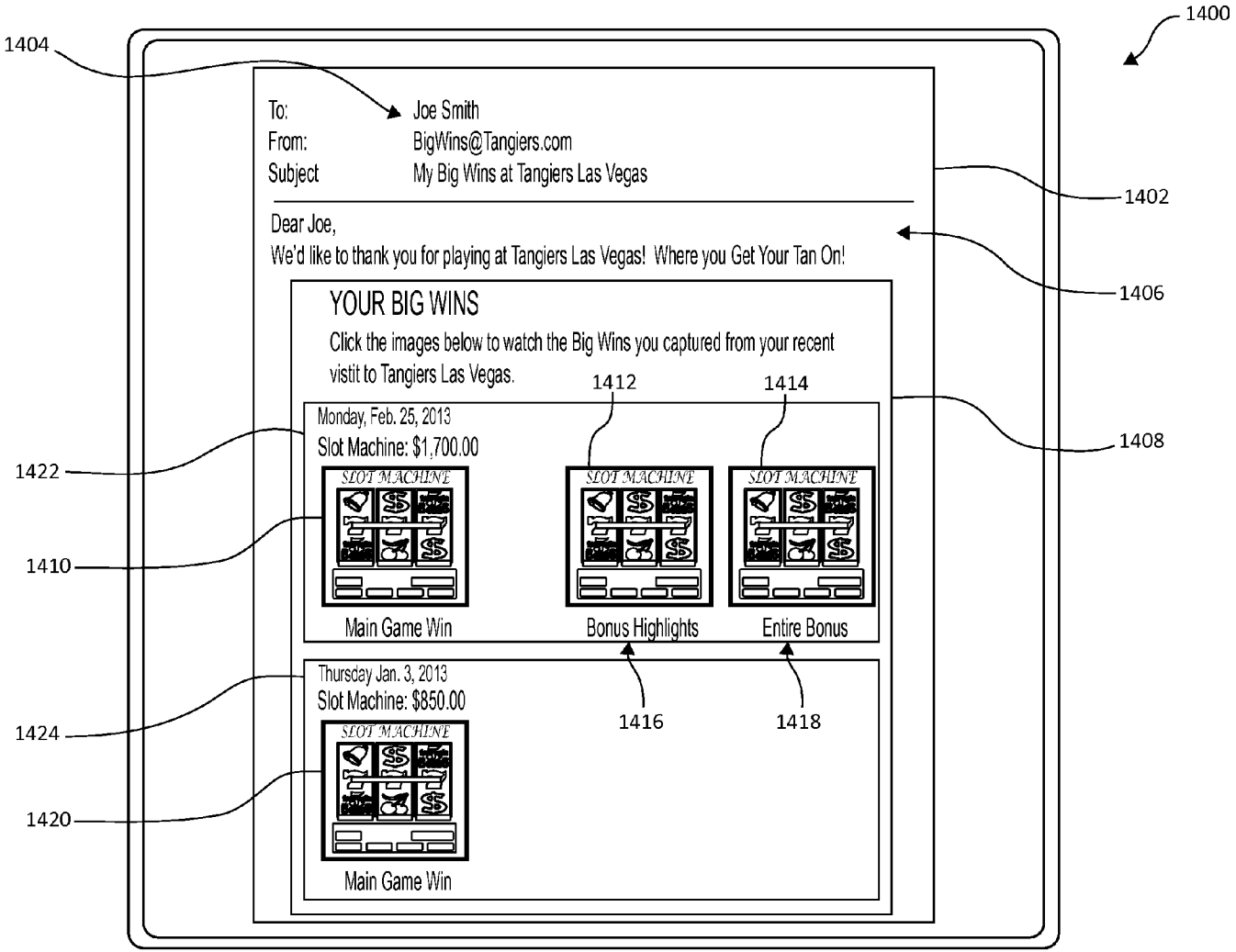
FIG. 14 is an exemplary graphical user interface (GUI) screen of a personal computing device of the player viewed at a subsequent time, here showing receipt of an email message with delivery a summary of re-created content.

FIG. 14 illustrates one such communications possibility with the player by further depicting a email message sent to player Joe Smith to indicate the various winning outcomes that were preserved for event re-creation. Here, display 1400 shows the email message 1402 to the player as indicated in the to, from, and subject lines of the email message 1404, as well as the email header information 1406, which includes greeting and further information about the winning outcomes that are displayed in window 1408, following.

Window 1408, in the depicted embodiment, organizes the winning outcomes by date as shown. In the first date window 1422 (corresponding to Feb. 25, 2013), the positive outcomes of the main game win icon 1410 of $1700 is seen. Adjacent to icon 1410 are icons 1412, reflecting an abridged "bonus highlights" version 1416, and icon 1414, reflecting the entire bonus version 1418. Below window 1422 is window 1424 (corresponding to a positive outcome on date Thursday Jan. 3, 2013). Window 1424 contains icon 1420, representing a main game win of $850.00

Display 1400 represents, in total, one possible embodiment for communicating representations of the positive outcomes to the player. The player sees the outcome icons 1410, 1412, 1414, and 1420 as representations of facsimile event re-creations that the player is able to view, edit, and share with acquaintances pursuant to the mechanisms of the illustrated embodiments of the present invention, as has been previously described. As one of ordinary skill in the art will appreciate, other mechanisms for displaying representations of possible facsimile event re-creations are contemplated.

Figure 15:
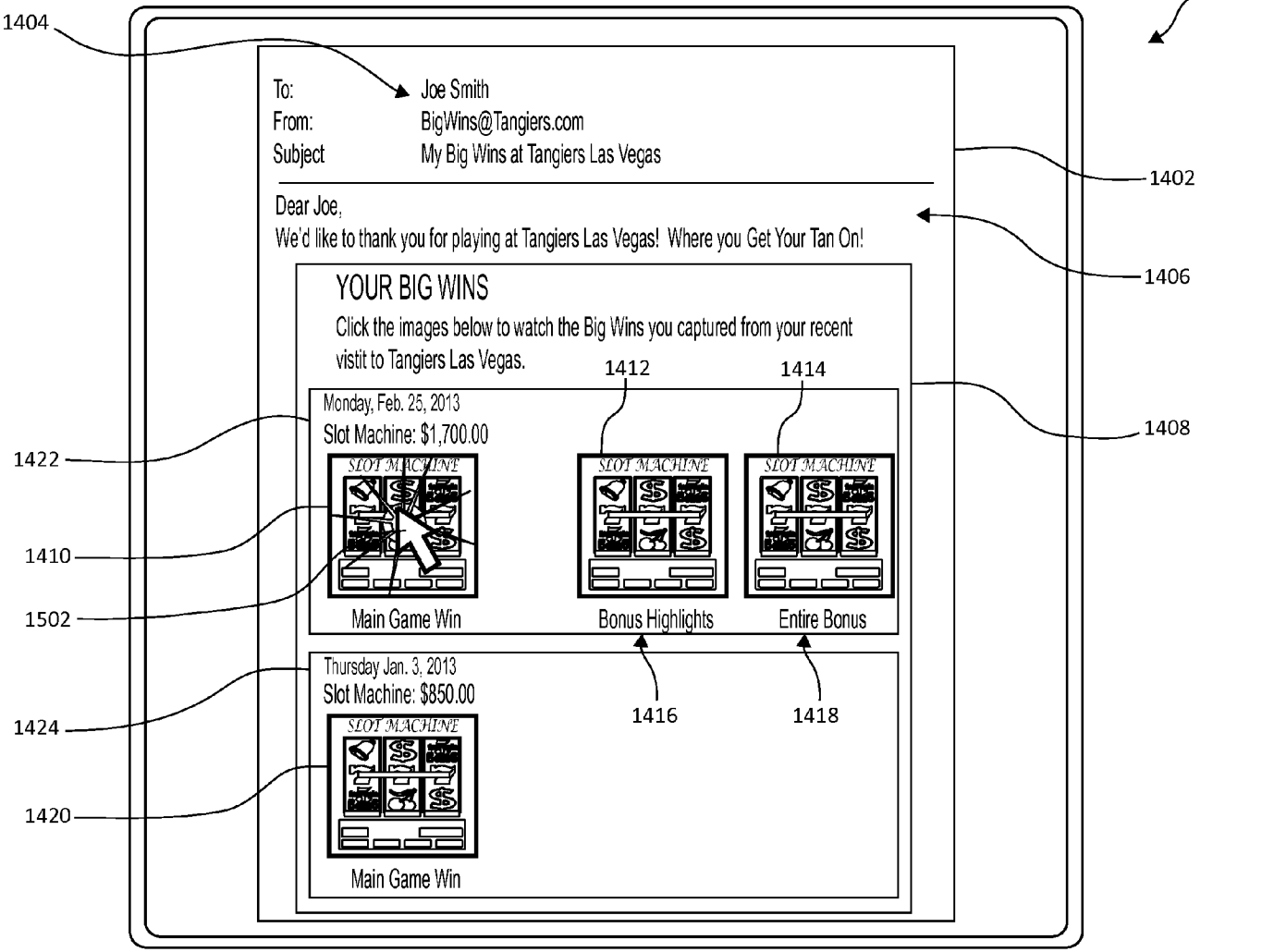
FIG. 15 is the exemplary GUI screen previously depicted in FIG. 14, here showing a selection of an available re-created content icon by a player.
Figure 16:
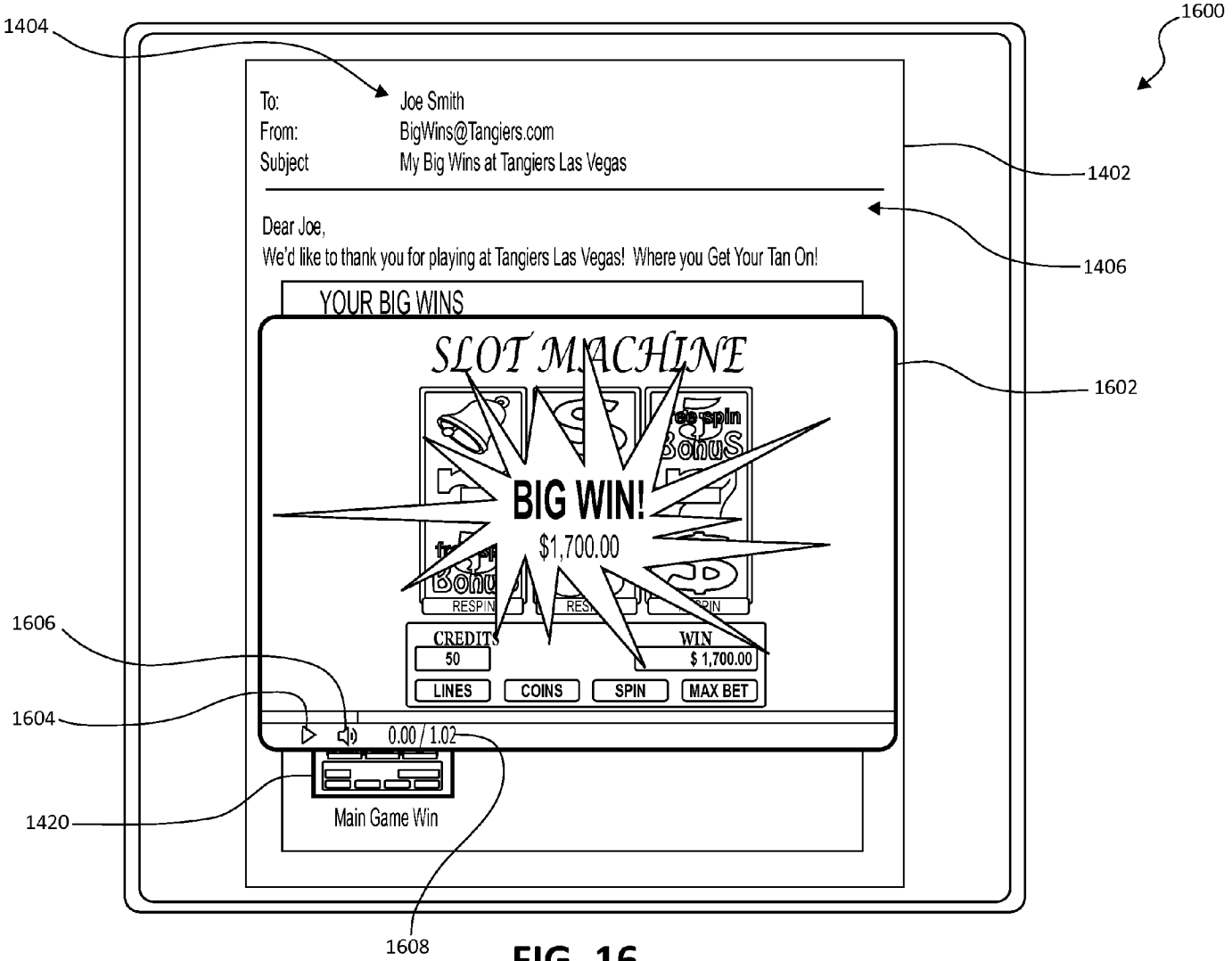
FIG. 16 is the exemplary GUI screen previously depicted in FIG. 14, here showing a "video" facsimile animation re-creation of the previously experienced event.

Turning now to FIG. 15, which illustrates display 1500, the player has selected icon 1410 with the cursor 1502 as shown. In one embodiment, selecting the icon 1410 then opens a browser window having a communication link to the data processing device/outcome editor previously described. The player is then able to enter validation information to confirm her identity, and is then granted access to perform the various event re-creation functionality previously described. FIG. 16, following, illustrating display 1600, provides window 1602, which depicts a possible "video" embodiment of the facsimile event re-creation. Here, the video-like elements of the facsimile event recreation are possible to be manipulated using play icon 1604, speaker icon 1606, all the while displaying the time 1608 in terms of elapsed and total time as shown. Here again, one of ordinary skill in the art will appreciate that the depiction of the facsimile event re-recreation is an exemplary embodiment and may vary according to the particular implementation.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that may contain, or store a program for use by or in connection with an instruction execution system, apparatus, or device.

Program code embodied on a computer readable medium may be transmitted using any appropriate medium, including but not limited to wireless, wired, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention have been described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that may direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the above figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, may be implemented by special purpose hardware-based systems that perform the specified functions or acts, or combinations of special purpose hardware and computer instructions.

What is claimed is:

1. A method for facilitating re-experience of an event of a gaming device having at least one payment acceptor with a player, comprising:

gathering data in a data processing device, in communication with, yet external to, the gaming device, the data processing device having been provided a sampling of data from the gaming device by a gaming system having supervisory hierarchical control over the gaming device, wherein the at least one payment acceptor receives physical media having a monetary value to establish a credit balance for a placement of one or more bets and to receive potential winnings resulting from one or more awards of the event, wherein the event is a gaming event resulting from the placement of the one or more bets using the payment acceptor;

processing at least a portion of the sampled data to generate a facsimile animation re-creation of the event to be provided to the player, wherein the facsimile animation re-creation is editable through the data processing device by use of at least one predefined rule, an operator of the data processing device, and a player granted subsequent access to the data processing device; and analyzing free spin information associated with the event to determine whether editing on the facsimile animation re-creation should be performed.

2. The method of claim 1, wherein if a number of free spins outcomes is determined to exceed a predetermined threshold in a certain time, determining to abridge the facsimile animation re-creation such that those free spin outcomes having a free spin value exceeding an additional predetermined threshold are preserved in an abridged facsimile animation re-creation.

3. The method of claim 1, further including defining the at least one predefined rule.

4. The method of claim 1, further including implementing an outcome editor allowing facilitation of editing functions on the facsimile animation re-creation by the player.

5. The method of claim 1, further including, in conjunction with providing the facsimile animation re-creation to the player, providing a complete version of the facsimile animation re-creation and at least one abridged version of the facsimile animation re-creation.

6. The method of claim 5, further including selecting which of the complete version and the at least one abridged version will be shared.

7. A system for facilitating re-experience of an event of a gaming device, having at least one payment acceptor, with a player, comprising:

a system device having supervisory hierarchical control over the gaming device, wherein the at least one payment acceptor receives physical media having a monetary value to establish a credit balance for a placement of one or more bets and to receive potential winnings resulting from one or more awards of the event, wherein the event is a gaming event resulting from the placement of the one or more bets using the payment acceptor; and a data processing device, in communication with, yet external to, the gaming device, the data processing device having been provided a sampling of data from the gaming device by the system device; wherein the data processing device:

gathers the sampled data provided by the system device, processes at least a portion of the sampled data to generate a facsimile animation re-creation of the event to be provided to the player, wherein the facsimile animation re-creation is editable through the data processing device by use of at least one predefined rule, an operator of the data processing device, and a player granted subsequent access to the data processing device, and analyzes free spin information associated with the event to determine whether editing on the facsimile animation re-creation should be performed.

8. The system of claim 7, wherein the data processing device determines, if a number of free spins outcomes is determined to exceed a predetermined threshold in a certain time, to abridge the facsimile animation re-creation such that those free spin outcomes having a free spin value exceeding an additional predetermined threshold are preserved in an abridged facsimile animation re-creation.

9. The system of claim 7, wherein the data processing device defines the at least one predefined rule.

10. The system of claim 7, wherein the data processing device implements an outcome editor allowing facilitation of editing functions on the facsimile animation re-creation by the player.

11. The system of claim 7, wherein the data processing device, in conjunction with providing the facsimile animation re-creation to the player, provides a complete version of the facsimile animation re-creation and at least one abridged version of the facsimile animation re-creation.

12. The system of claim 10, wherein the data processing device selects which of the complete version and the at least one abridged version will be shared.

13. A computer program product for facilitating re-experience of an event of a gaming device, having at least one payment acceptor, with a player, the computer program product comprising a non-transitory computer-readable storage medium having computer-readable program code portions stored therein, the computer-readable program code portions comprising:

a first executable portion that gathers data in a data processing device, in communication with, yet external to, the gaming device, the data processing device having been provided a sampling of data from the gaming device by a gaming system having supervisory hierarchical control over the gaming device, wherein the at least one payment acceptor receives physical media having a monetary value to establish a credit balance for a placement of one or more bets and to receive potential winnings resulting from one or more awards of the event, wherein the event is a gaming event resulting from the placement of the one or more bets using the payment acceptor;

a second executable portion that processes at least a portion of the sampled data to generate a facsimile animation re-creation of the event to be provided to the player, wherein the facsimile animation re-creation is editable through the data processing device by use of at least one predefined rule, an operator of the data processing device, and a player granted subsequent access to the data processing device; and a third executable portion that analyzes free spin information associated with the event to determine whether editing on the facsimile animation re-creation should be performed.

14. The computer program product of claim 13, further including a fourth executable portion that, if a number of free spins outcomes is determined to exceed a predetermined threshold in a certain time, determines to abridge the facsimile animation re-creation such that those free spin outcomes having a free spin value exceeding an additional predetermined threshold are preserved in an abridged facsimile animation re-creation.

15. The computer program product of claim 13, further including a fourth executable portion that defines the at least one predefined rule.

16. The computer program product of claim 13, further including a fourth executable portion that implements an outcome editor allowing facilitation of editing functions on the facsimile animation re-creation by the player.

17. The computer program product of claim 13, further including a fourth executable portion that, in conjunction with providing the facsimile animation re-creation to the player, provides a complete version of the facsimile animation re-creation and at least one abridged version of the facsimile animation re-creation.

18. The computer program product of claim 17, further including a fifth executable portion that selects which of the complete version and the at least one abridged version will be shared.

* * * * *